US010214945B2

(12) United States Patent
Cetnar

(10) Patent No.: US 10,214,945 B2
(45) Date of Patent: Feb. 26, 2019

(54) DOOR LATCH ASSEMBLY FOR MOTOR VEHICLES

(71) Applicant: MAGNA CLOSURES INC., Newmarket (CA)

(72) Inventor: Roman Cetnar, Newmarket (CA)

(73) Assignee: MAGNA CLOSURES INC., Newmarket (CA)

( * ) Notice: Subject to any disclaimer, the term of this patent is extended or adjusted under 35 U.S.C. 154(b) by 951 days.

(21) Appl. No.: 14/601,283

(22) Filed: Jan. 21, 2015

(65) Prior Publication Data

US 2015/0204118 A1 Jul. 23, 2015

Related U.S. Application Data

(60) Provisional application No. 61/930,699, filed on Jan. 23, 2014.

(51) Int. Cl.

| | |
|---|---|
| ***E05B 85/20*** | (2014.01) |
| ***E05B 77/02*** | (2014.01) |
| ***E05B 77/30*** | (2014.01) |
| ***E05B 79/20*** | (2014.01) |
| ***E05B 81/16*** | (2014.01) |
| ***E05B 81/36*** | (2014.01) |
| ***E05B 81/74*** | (2014.01) |

(52) U.S. Cl.

CPC ..... *E05B 85/20* (2013.01); *E05B 77/02* (2013.01); *E05B 77/30* (2013.01); *E05B 79/20* (2013.01); *E05B 81/16* (2013.01); *E05B 81/36* (2013.01); *E05B 81/74* (2013.01); *Y10T 292/108* (2015.04); *Y10T 292/1077* (2015.04); *Y10T 292/1079* (2015.04)

(58) Field of Classification Search

CPC ..... Y10T 292/1082; Y10T 292/1047; Y10T 292/1079; Y10T 70/5889; E05B 81/06; E05B 81/16; Y10S 292/23

See application file for complete search history.

(56) References Cited

U.S. PATENT DOCUMENTS

| | | | |
|---|---|---|---|
| 4,364,249 | A | 12/1982 | Kleefeldt |
| 4,978,154 | A | 12/1990 | Kleefeldt et al. |
| 5,100,185 | A | 3/1992 | Menke et al. |
| 5,439,261 | A | 8/1995 | O'Hare |
| 5,494,322 | A | 2/1996 | Menke |
| 5,538,298 | A | 7/1996 | Ikeda |
| 5,577,782 | A | 11/1996 | Johnson et al. |
| 5,615,564 | A | 4/1997 | Inoue |
| 5,638,712 | A | 6/1997 | Kuroda |
| 5,653,484 | A | 8/1997 | Brackmann et al. |

(Continued)

FOREIGN PATENT DOCUMENTS

| | | | |
|---|---|---|---|
| DE | 10339542 | A1 | 5/2005 |
| DE | 102005052190 | A1 | 5/2007 |

*Primary Examiner* — Mark A Williams

(74) *Attorney, Agent, or Firm* — Dickinson Wright PLLC

(57) ABSTRACT

A door latch assembly is equipped with a latch mechanism, a locking mechanism, an operating mechanism and inside and outside release mechanisms. The locking mechanism includes a release link that is connected to an inside release lever connected to the inside release mechanism. This arrangement permits a vehicle door to be opened from inside the passenger compartment via actuation of the inside release mechanism in the event the outside release mechanism is damaged.

21 Claims, 22 Drawing Sheets

(56) References Cited

U.S. PATENT DOCUMENTS

| | | | | |
|---|---|---|---|---|
| 5,683,125 | A | 11/1997 | Tseng | |
| 5,715,713 | A | 2/1998 | Aubry et al. | |
| 5,921,595 | A | 7/1999 | Brackmann et al. | |
| 5,961,163 | A | 10/1999 | Brackmann et al. | |
| 6,007,118 | A | 12/1999 | Arabia, Jr. et al. | |
| 6,010,165 | A | 1/2000 | Santarelli et al. | |
| 6,123,371 | A | 9/2000 | Fisher | |
| 6,328,353 | B1 | 12/2001 | Barczynski et al. | |
| 6,343,817 | B1 | 2/2002 | Watanabe | |
| 6,406,073 | B1 * | 6/2002 | Watanabe | E05B 77/265 292/216 |
| 6,416,088 | B1 | 7/2002 | Graute | |
| 6,428,058 | B1 | 8/2002 | Graute | |
| 6,519,986 | B2 * | 2/2003 | Wicker | E05B 81/06 292/201 |
| 6,520,550 | B2 | 2/2003 | Kunst et al. | |
| 6,523,367 | B1 * | 2/2003 | Ikeda | B01D 46/543 65/30.1 |
| 6,568,722 | B2 | 5/2003 | Raffelsiefer et al. | |
| 6,824,177 | B1 | 11/2004 | Nass et al. | |
| 7,080,861 | B2 | 7/2006 | Watanabe | |
| 7,125,057 | B2 | 10/2006 | Coleman et al. | |
| 7,243,960 | B2 | 7/2007 | Hoshikawa et al. | |
| 7,261,335 | B2 | 8/2007 | Schupp | |
| 7,399,010 | B2 | 7/2008 | Hunt et al. | |
| 7,441,815 | B2 | 10/2008 | Umino | |
| 7,568,741 | B2 | 8/2009 | Odahara | |
| 7,770,945 | B2 | 8/2010 | Umino | |
| 7,931,312 | B2 | 4/2011 | Mochizuki et al. | |
| 2001/0035653 | A1 | 11/2001 | Hayakawa et al. | |
| 2004/0094971 | A1 | 5/2004 | Warmke et al. | |
| 2005/0236847 | A1 * | 10/2005 | Taniyama | E05B 81/06 292/216 |
| 2010/0236300 | A1 | 9/2010 | Wilms et al. | |

* cited by examiner

DOOR LATCH ASSEMBLY FOR MOTOR VEHICLES

CROSS REFERENCE TO RELATED APPLICATIONS

This application claims the benefit of and priority to U.S. Provisional Application No. 61/930,699, filed Jan. 23, 2014, the entire disclosure of which is incorporated herein by reference.

FIELD

The present disclosure relates generally to vehicle door latches and, more specifically, to a vehicle door latch assembly having a release mechanism with a release link operatively connected to an inside release lever for movement in response to actuation of an inside door release mechanism.

BACKGROUND

This section provides a general summary of background information and the comments and examples provided in this section are not necessarily prior art to the present disclosure.

A vehicle closure, such as a door for a vehicle passenger compartment, is hinged to swing between open and closed positions and typically includes a door latch assembly that is housed between inner and outer panels of the door. The door latch assembly functions in a well-known manner to latch the door when closed, to lock the door in the closed position and to unlock and unlatch the door so that the door can be opened.

The door latch assembly can be operated remotely from the exterior of the automobile by at least two distinct operators which typically include a key cylinder that controls a locking mechanism and an outside door handle that controls a release mechanism. The door latch assembly can also be operated remotely from inside the passenger compartment by at least two distinct operators which typically include a sill button or pull knob that controls the locking mechanism and an inside door handle that controls the release mechanism. Vehicle door latch assembles may also include other features such as, for example, power door locks in which the locking mechanism is motor driven and/or a keyless entry system in which a key fob transmitter sends a signal to a receiver in the vehicle to operate the motor-driven locking mechanism.

While door latch assemblies of the type noted above operate satisfactorily for their intended purpose, a recognized need exists to make further improvements in an effort to reduce complexity, weight and cost while concomitantly improving performance. To this end, a specific need exists to develop a door latch assembly having a release mechanism capable of permitting release of the locking mechanism from within the passenger compartment via actuation of an inside door release mechanism. Such a design configuration would be advantageous in the event that a side impact causes damage to the door's outer panel which hinders release of the locking mechanism via actuation of the outside door release mechanism.

SUMMARY

This section provides a general summary of the inventive concepts associated with the present disclosure and is not intended to represent a comprehensive disclosure of its full scope or all of its features, object, aspects and advantages.

In accordance with one embodiment of a door latch assembly constructed in accordance with the present disclosure, there is provided a latch mechanism, a locking mechanism and an inside release mechanism operably associated and configured to overcome the shortcomings of conventional door latches and which addresses the above-noted need.

In accordance with this embodiment of the present disclosure, the door latch assembly is provided with a locking mechanism equipped with a release link that is operably connected to an inside release lever instead of an outside release lever. This arrangement permits the door to be opened via actuation of an inside release mechanism despite damage to an outside release mechanism caused by a side impact collision.

In accordance with these and other aspects and objectives, the present disclosure provides a vehicle door latch assembly comprising a latch mechanism, a locking mechanism, an operating mechanism and an inside release mechanism. The latch mechanism includes a ratchet and a pawl. The ratchet is pivotably moveable about a ratchet pivot axis between a striker capture position wherein the ratchet is positioned to retain a striker and a striker release position wherein the ratchet is positioned to release the striker. The pawl is pivotably moveable about a pawl pivot axis between a ratchet hold position wherein the pawl is positioned to hold the ratchet in its striker capture position and a ratchet release position wherein the pawl permits movement of the ratchet toward its striker release position. A pawl lever is connected for movement with the pawl about the pawl pivot axis. The locking mechanism includes an inside release lever and a release link. The inside release lever is pivotally moveable between a rest position and a released position. The inside release mechanism operably interconnects the inside release lever to an inside door handle for controlling movement of the inside release lever in response to movement of the inside door handle. The release link is pivotally coupled to the inside release lever and is moveable between an unlock position and a lock position relative to the inside release lever in response to actuation of the operating mechanism. Pivotal movement of the inside release lever between its rest position and its released position further causes movement of the release link between a retracted position and an extended position relative to the pawl lever. The release link is operable to selectively engage the pawl lever and move the pawl from its ratchet hold position into its ratchet release position when the release link is in its unlock position and movement of the inside release lever from its rest position to its release position causes the release link to move from its retracted position to its extended position.

In accordance with another embodiment of the present disclosure, the door latch assembly comprises a latch mechanism, a locking mechanism, an operating mechanism, an inside release mechanism and an outside release mechanism. The latch mechanism includes a ratchet and a pawl. The ratchet is pivotably moveable between a striker capture position wherein the ratchet is positioned to retain a striker and a striker release position wherein the ratchet is positioned to release the striker. The pawl is pivotably moveable between a ratchet hold position wherein the pawl is positioned to hold the ratchet in its striker capture position and a ratchet release position wherein the pawl permits movement of the ratchet into its striker release position. A pawl lever is coupled for movement with the pawl. The locking mechanism includes an inside release lever, an outside release lever and a release link. The inside release lever is moveable between a rest position and a released position. The inside release mechanism operably interconnects the inside release lever to an inside door handle for controlling movement of the inside release lever in response to movement of the inside door handle. The outside release lever is moveable between a rest position and a released position. The outside release mechanism operably interconnects the outside release lever to an outside door handle for controlling movement of the outside release lever in response to movement of the outside door handle. The release link is pivotably coupled to the inside release lever for movement between an unlock position and a lock position in response to actuation of the operating mechanism. Movement of the inside release lever between its rest position and its released position also causes movement of the release link between a retracted position and an extended position relative to the pawl lever. The release link is operable to selectively engage the pawl lever and more the pawl from its ratchet hold position to its ratchet release position when the release link is in its unlock position and movement of the inside release lever from its rest position to its released position causes the release link to move from its retracted position to its extended position. The outside release lever is engaged with the release link when the release link is in its unlock position and is disengaged therefrom when the release link is in its lock position. Movement of the outside release lever from its rest position into its released position when the release link is in its unlock position causes the release link to move from its retracted position to its extended position for engaging the pawl lever and moving the pawl from its ratchet hold position into its ratchet release position.

In accordance with another embodiment of the present disclosure, the door latch assembly described above further includes an override feature associated with the latch mechanism. The override features includes an enlarged pawl lever configured to engage the release link in both of its unlock and lock positions in response to movement of the release link from its retracted position into its extended position resulting from movement of the inside release lever from its rest position to its released position.

Further areas of applicability will become apparent from the detailed written description provided herein. The description and specific examples provided in this summary section are intended for purpose of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 9A:
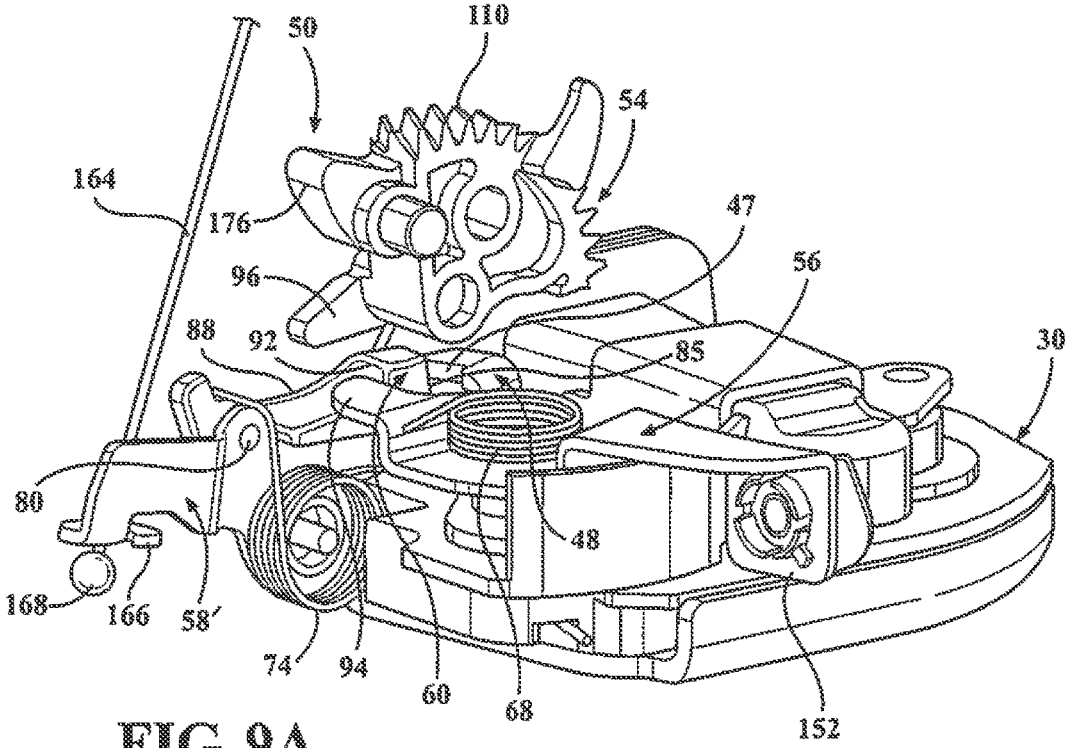
Figure 9B:
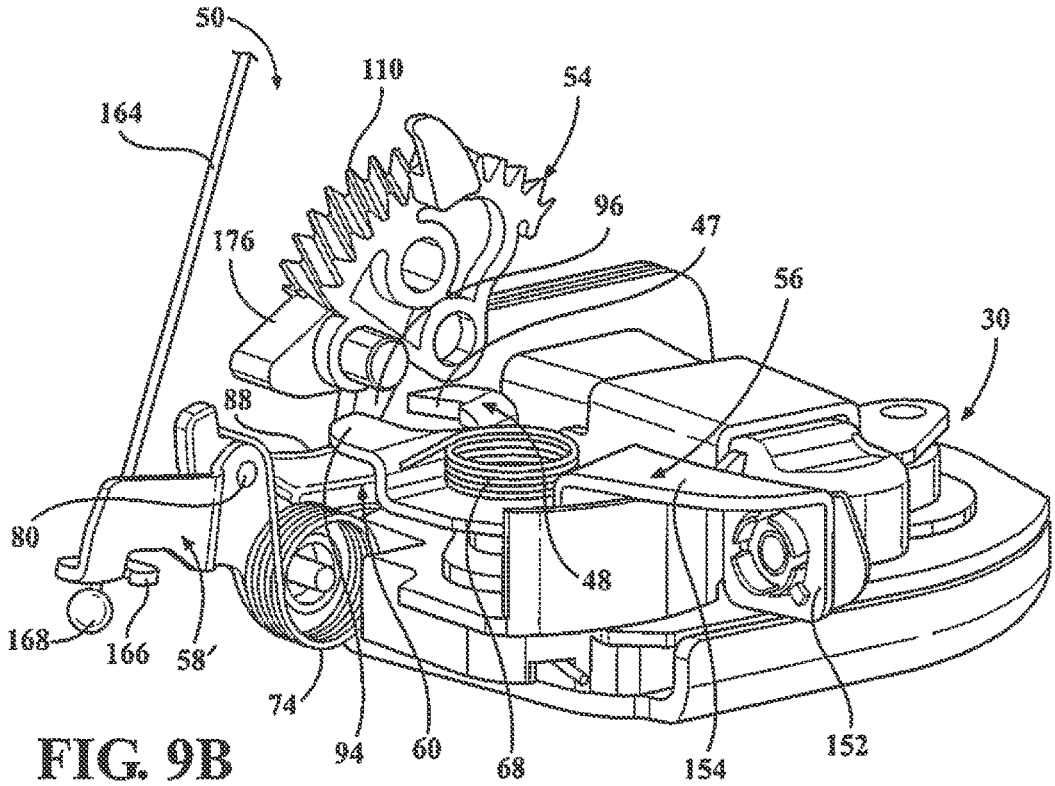
Figure 10:
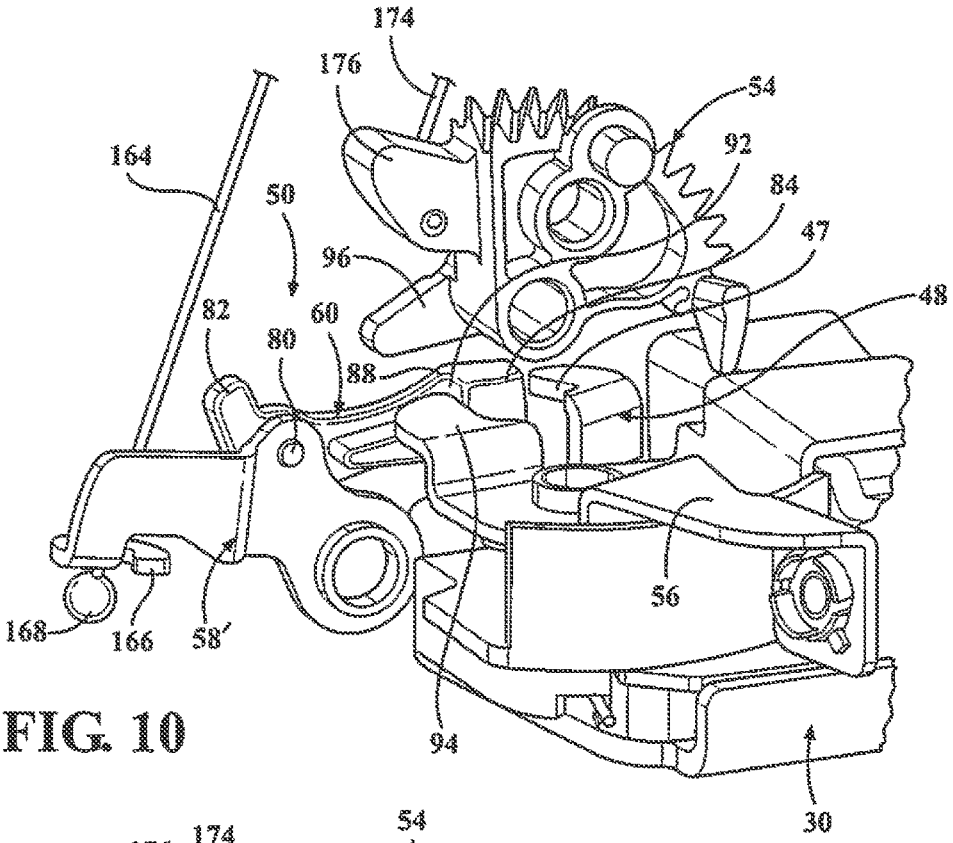
Figure 12:
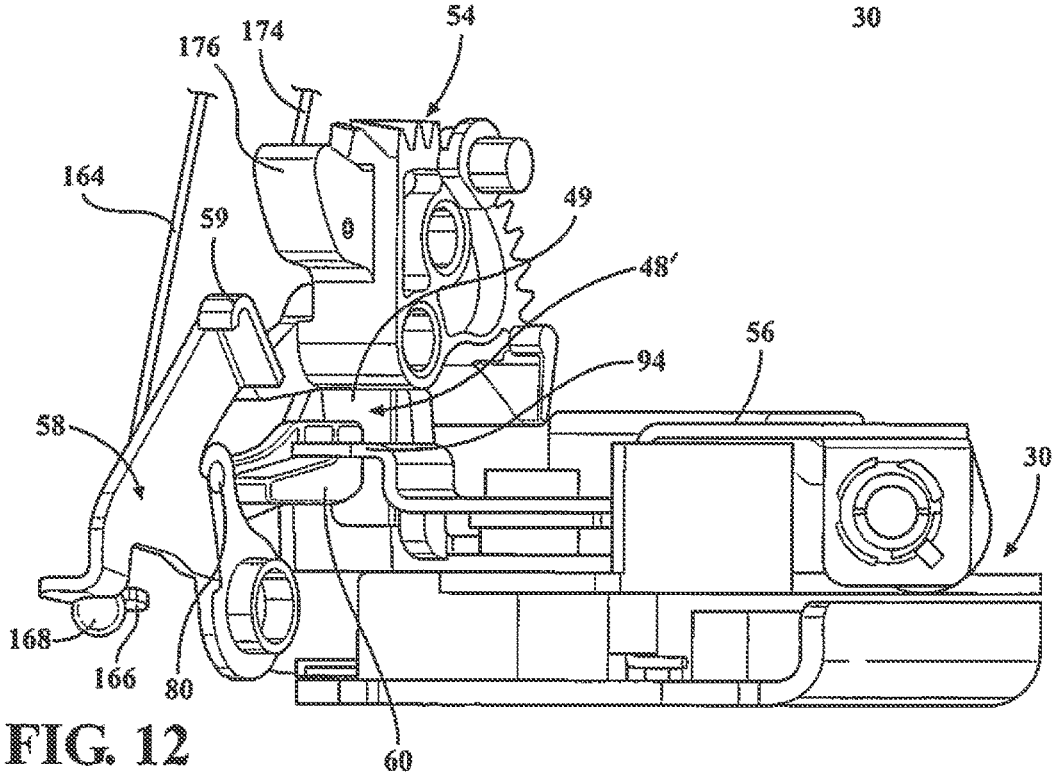
Figure 11:
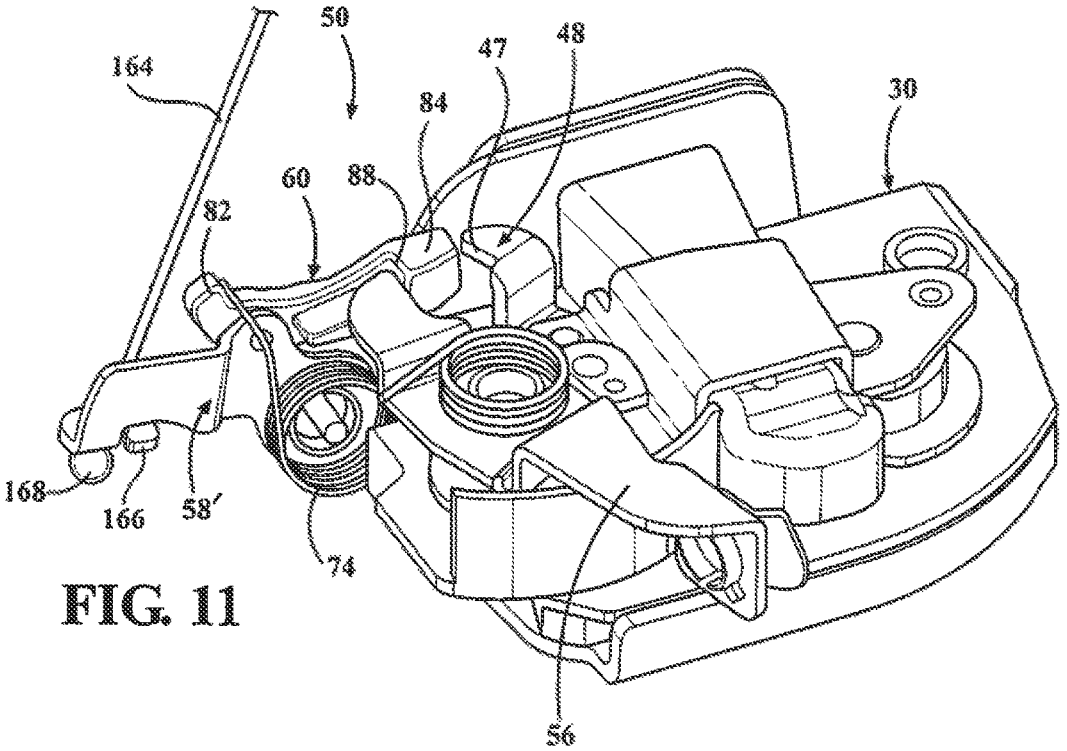
Figure 13:
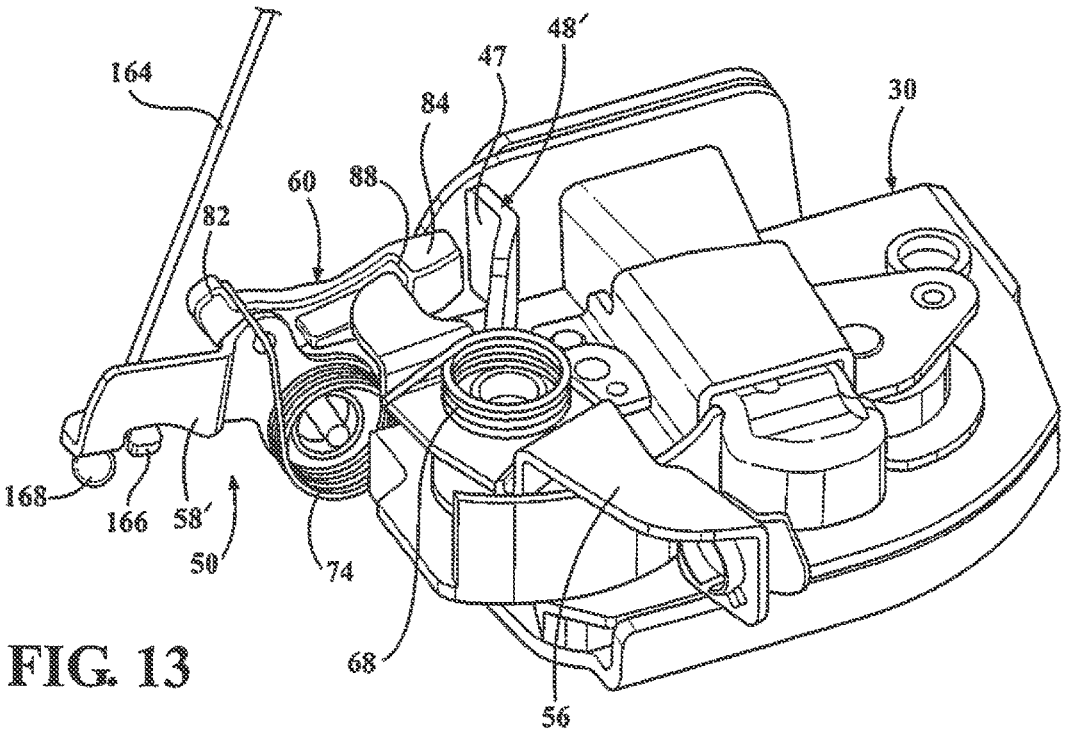
Figure 14:
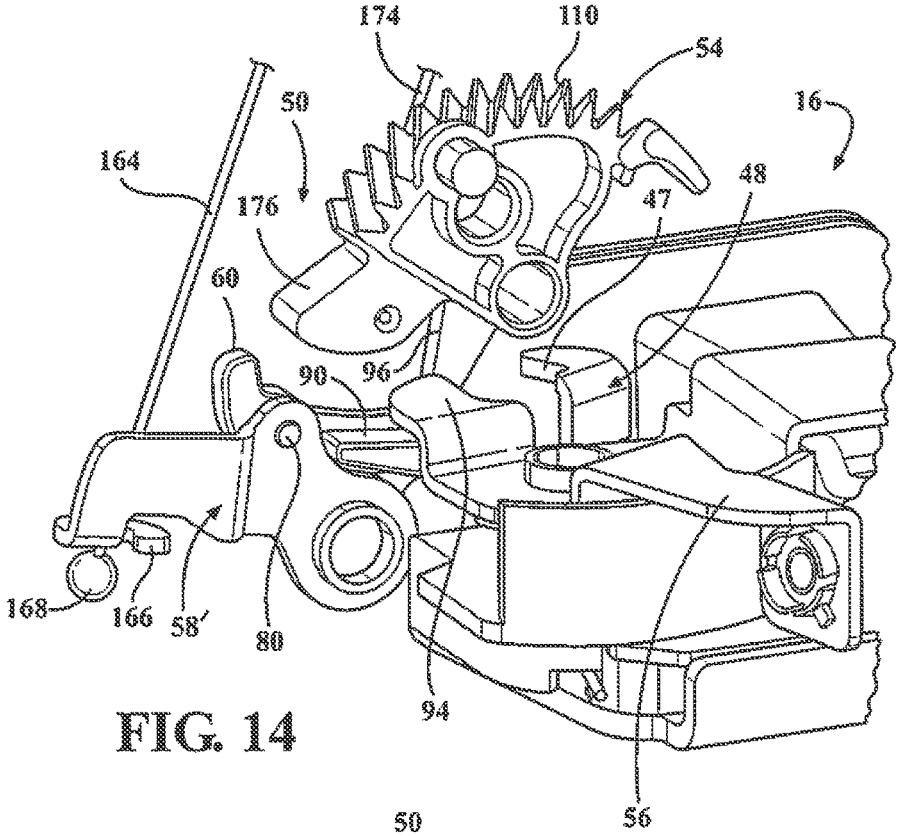
Figure 16:
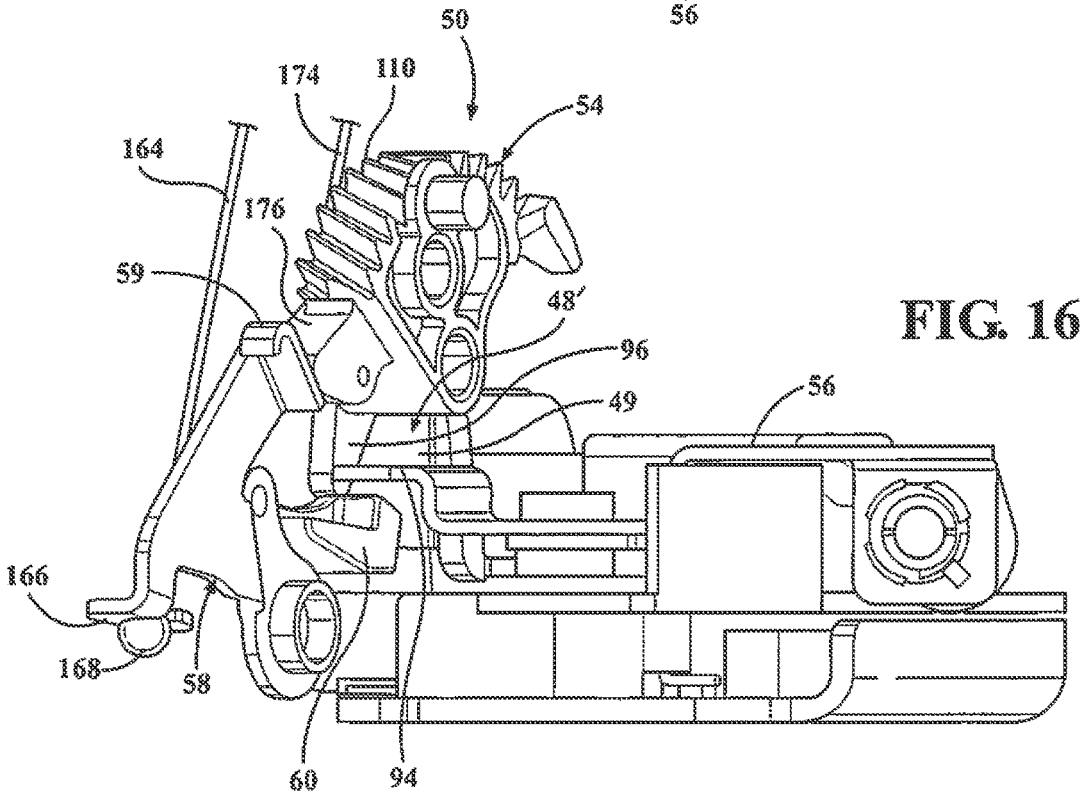
Figure 15:
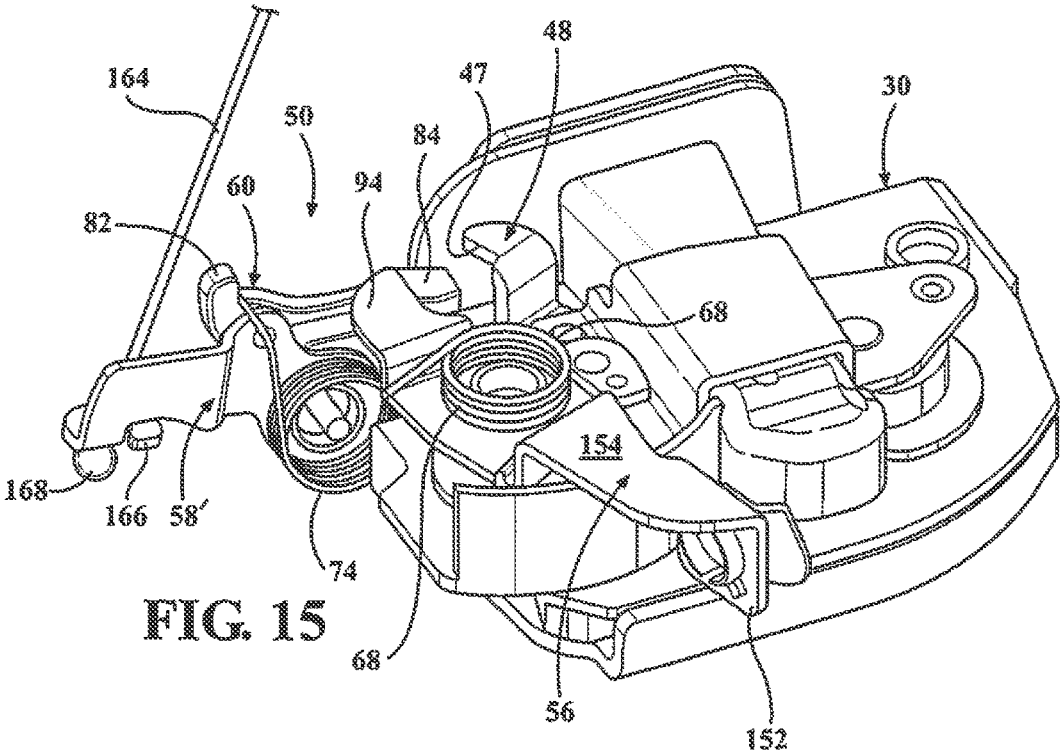
Figure 17:
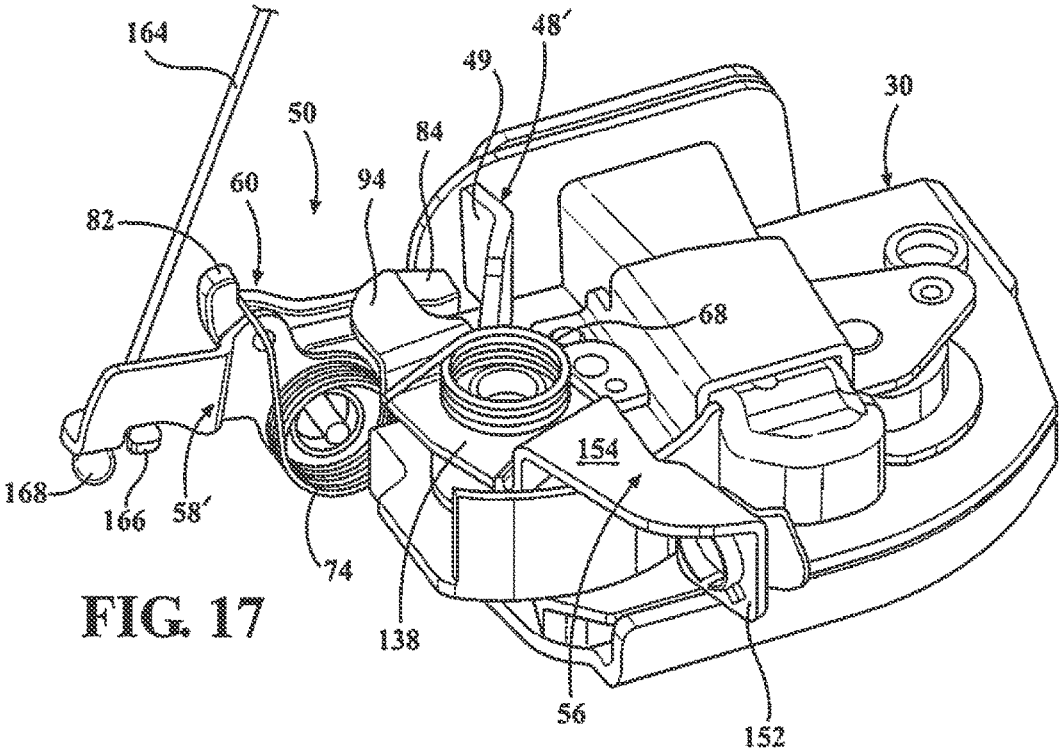
Figure 18:
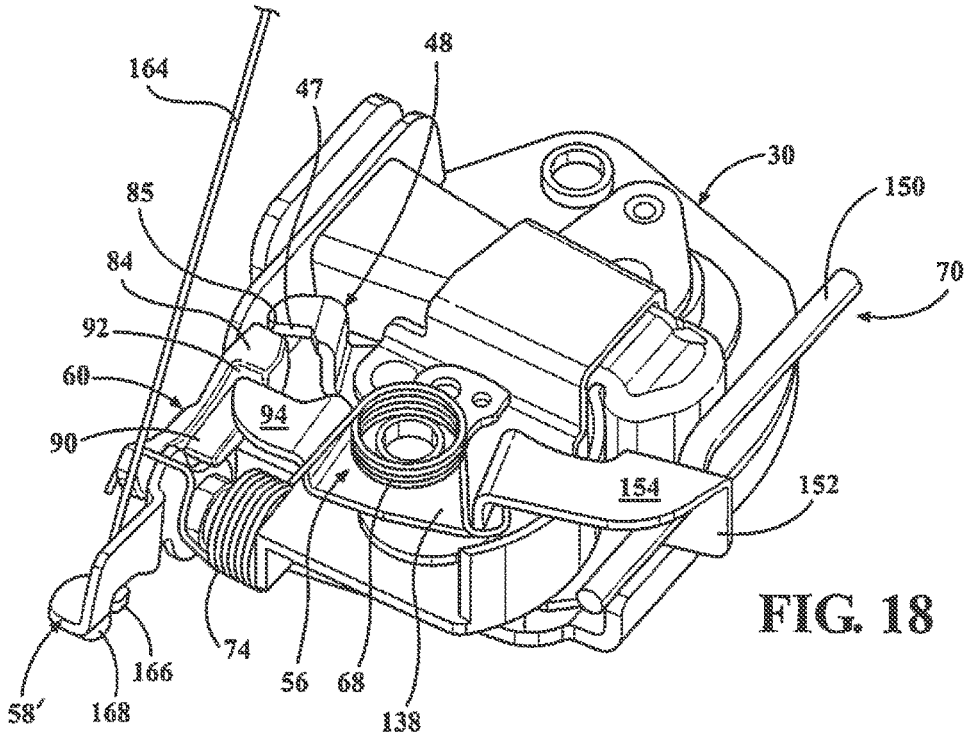
Figure 20:
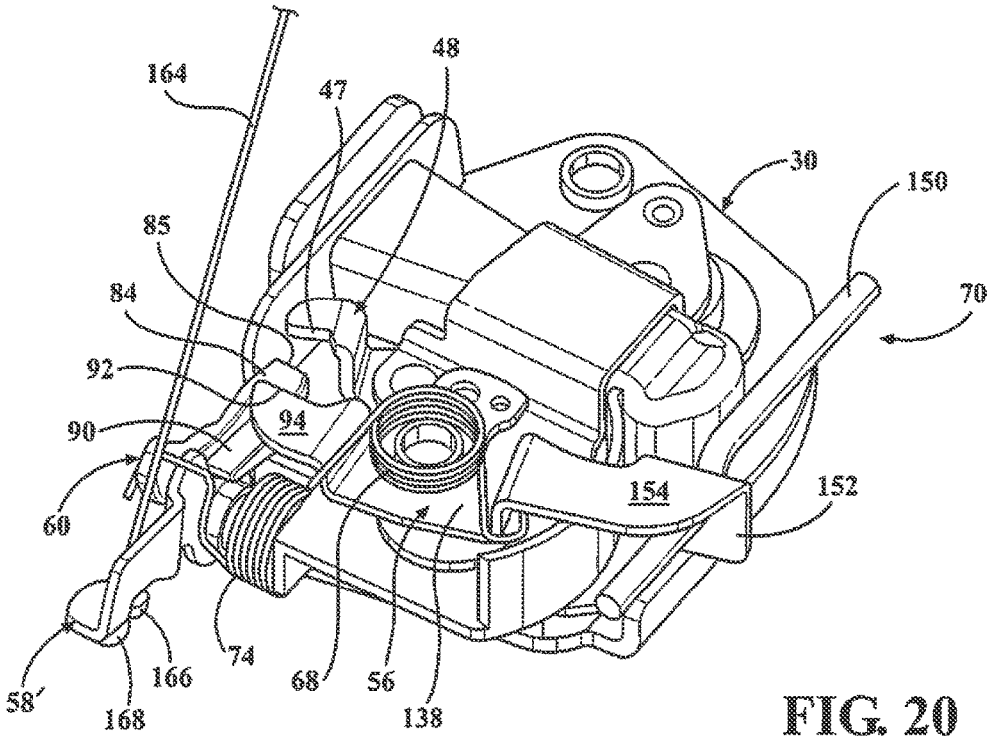
Figure 19:
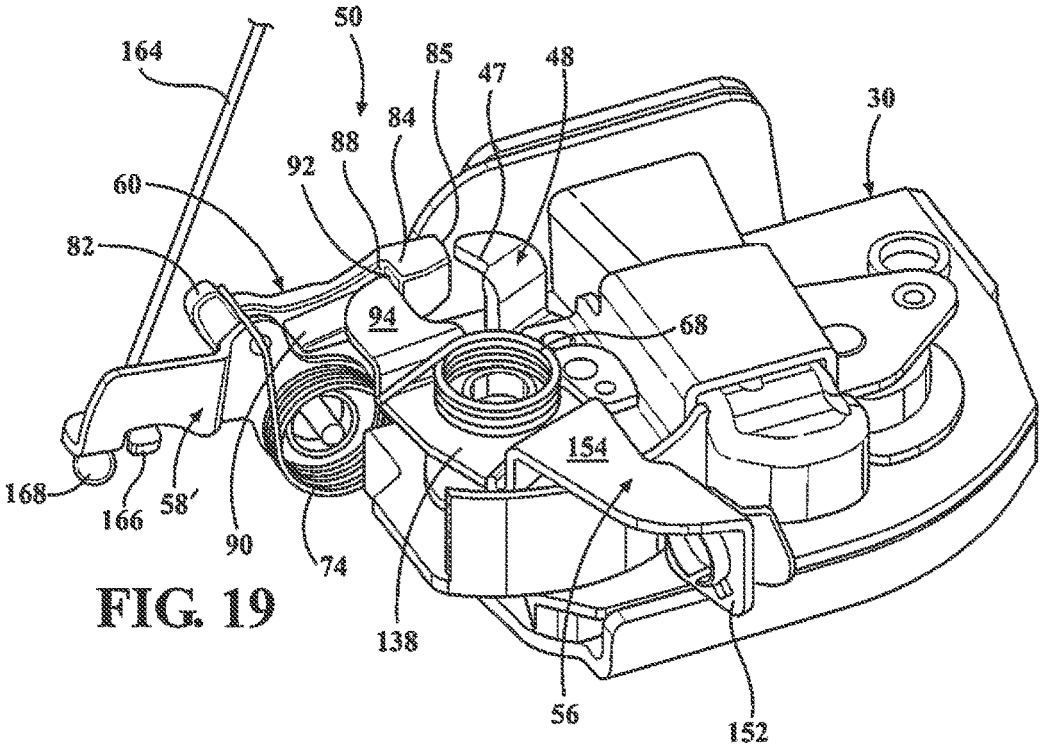
Figure 21:
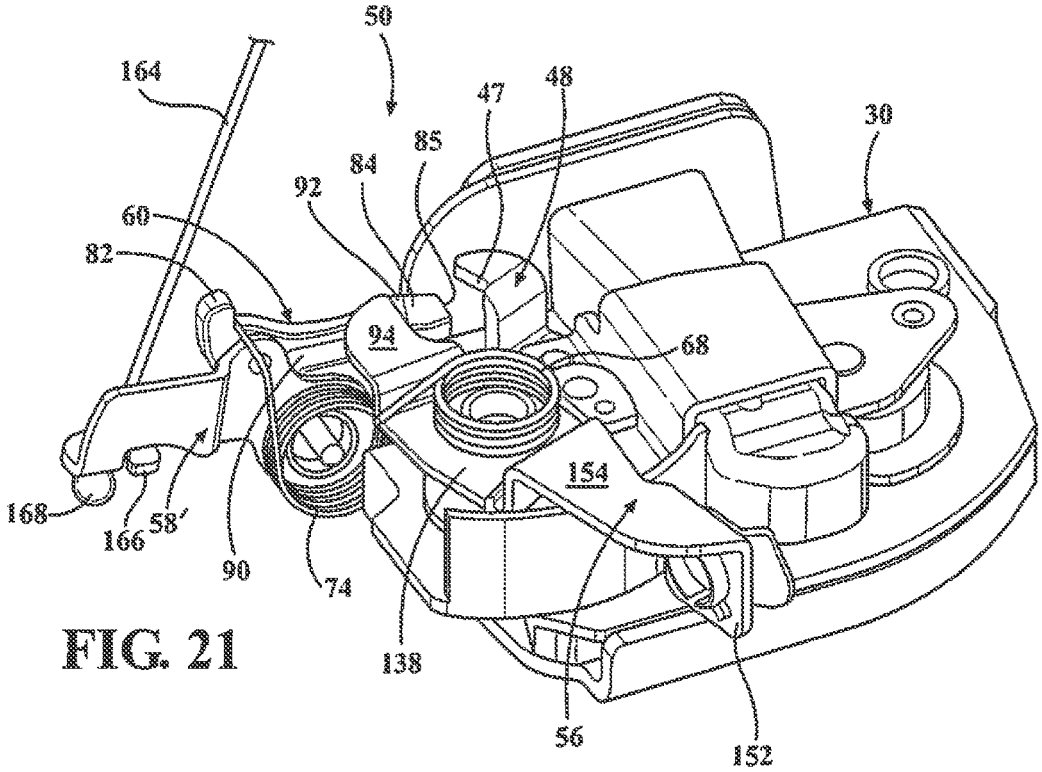
Figure 22:
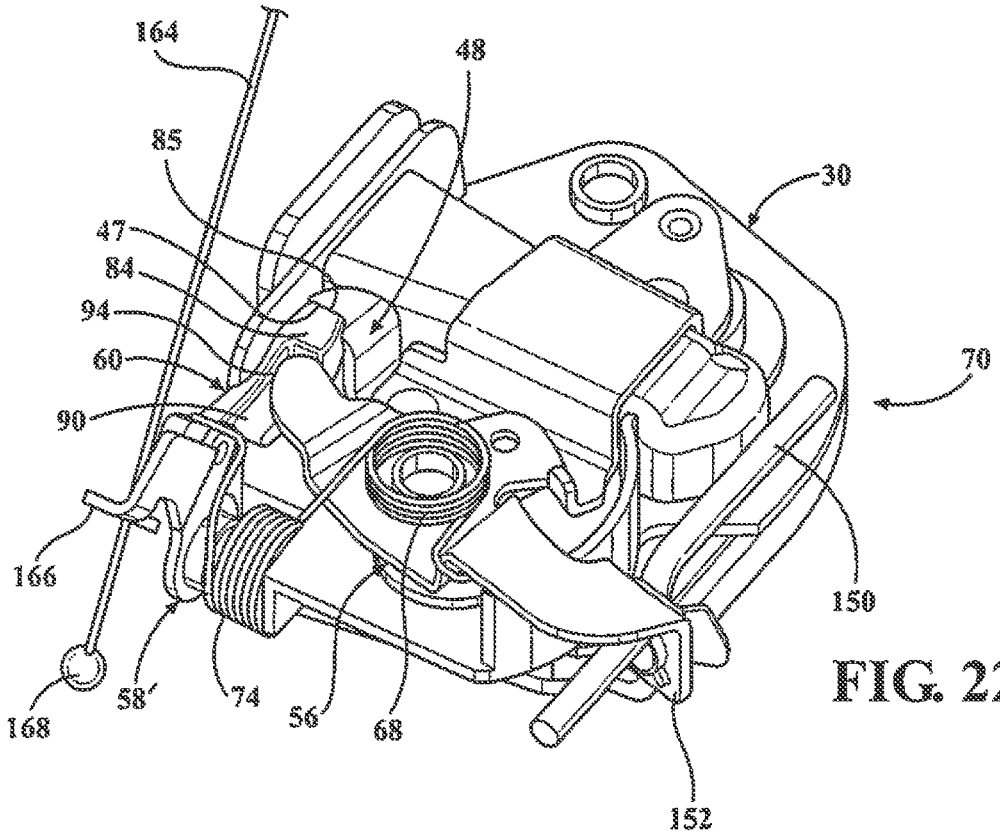
Figure 24:
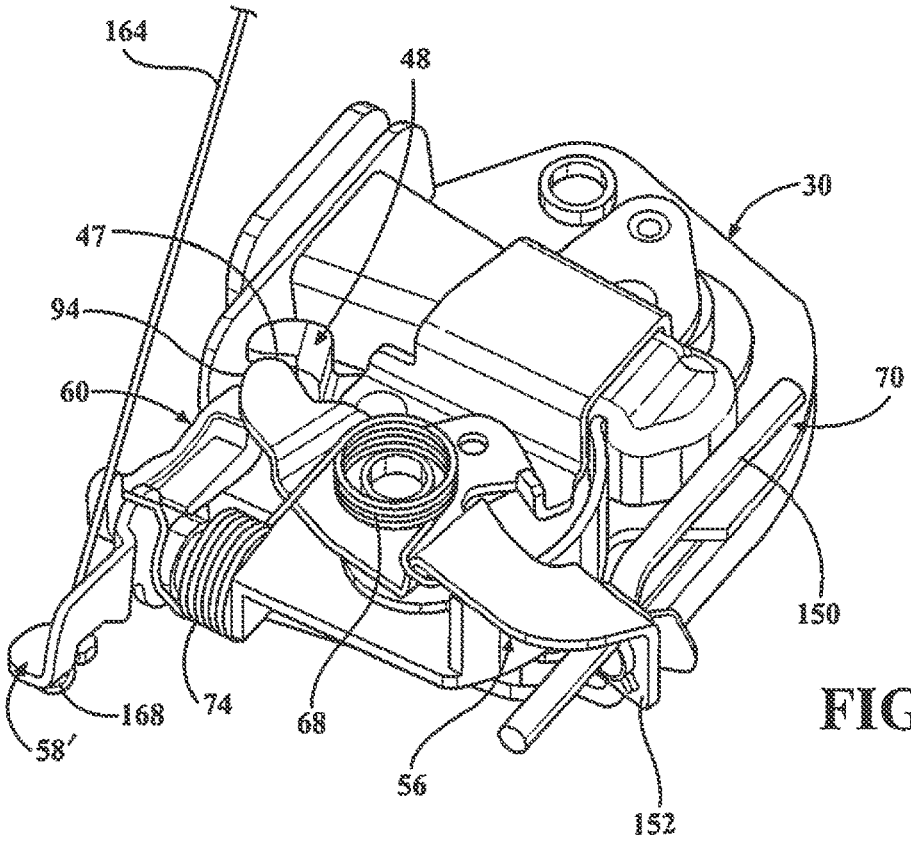
Figure 23:
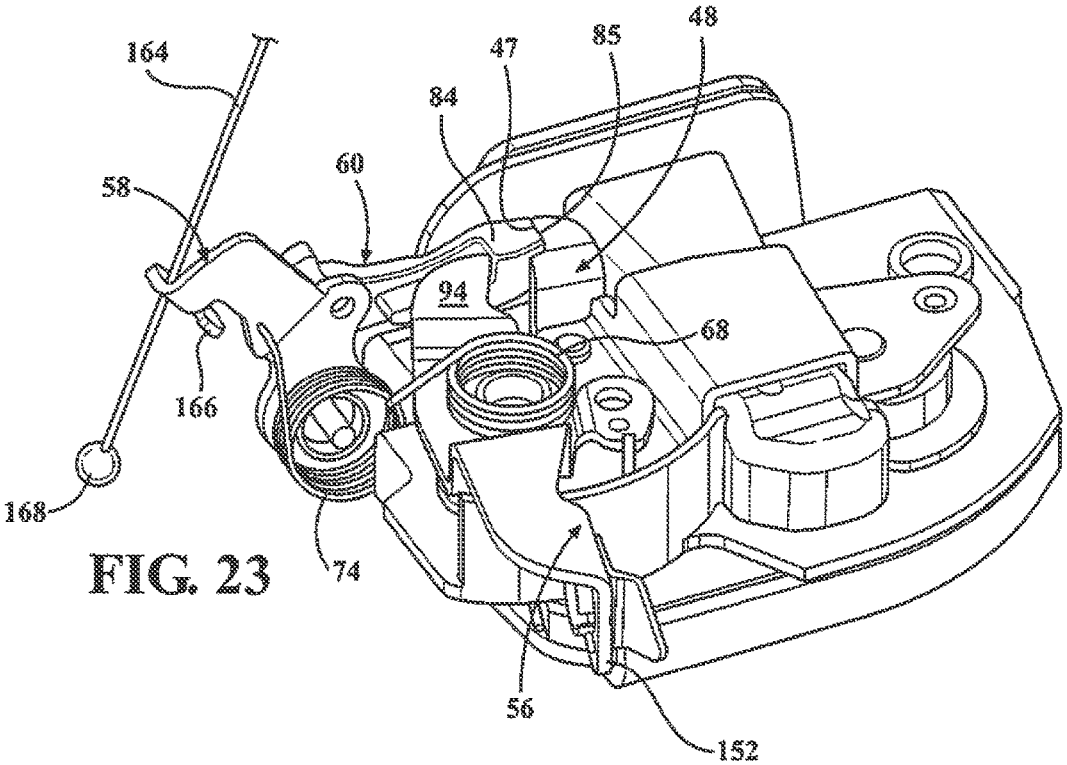
Figure 25:
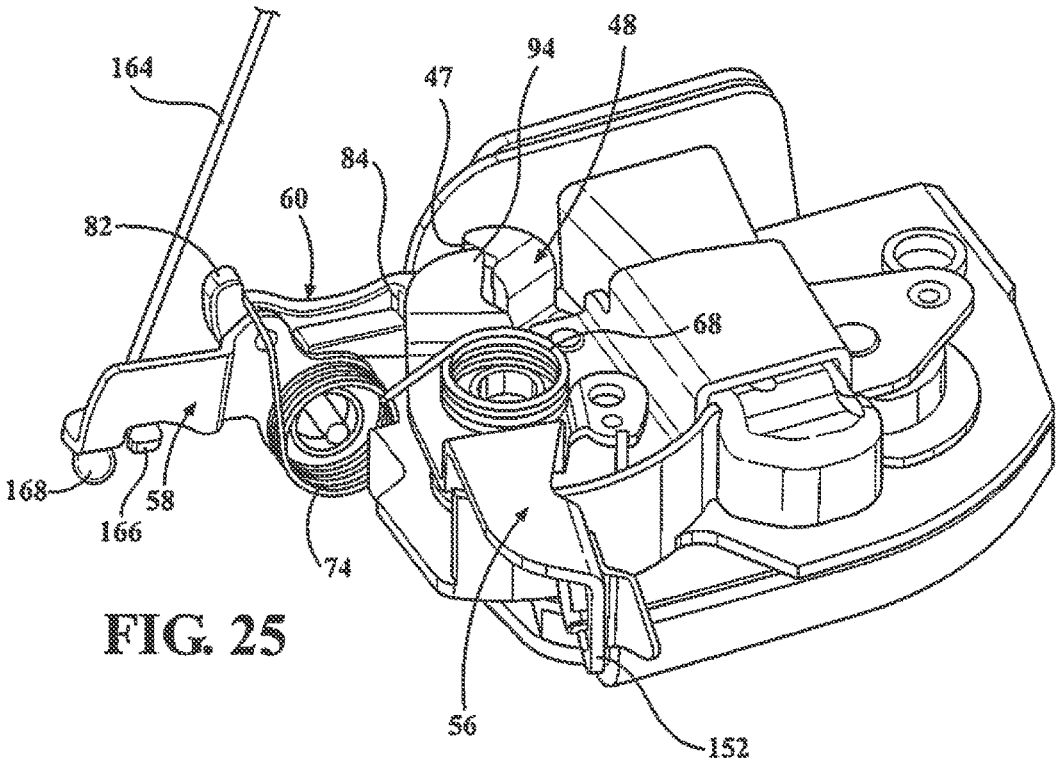
Figure 26:
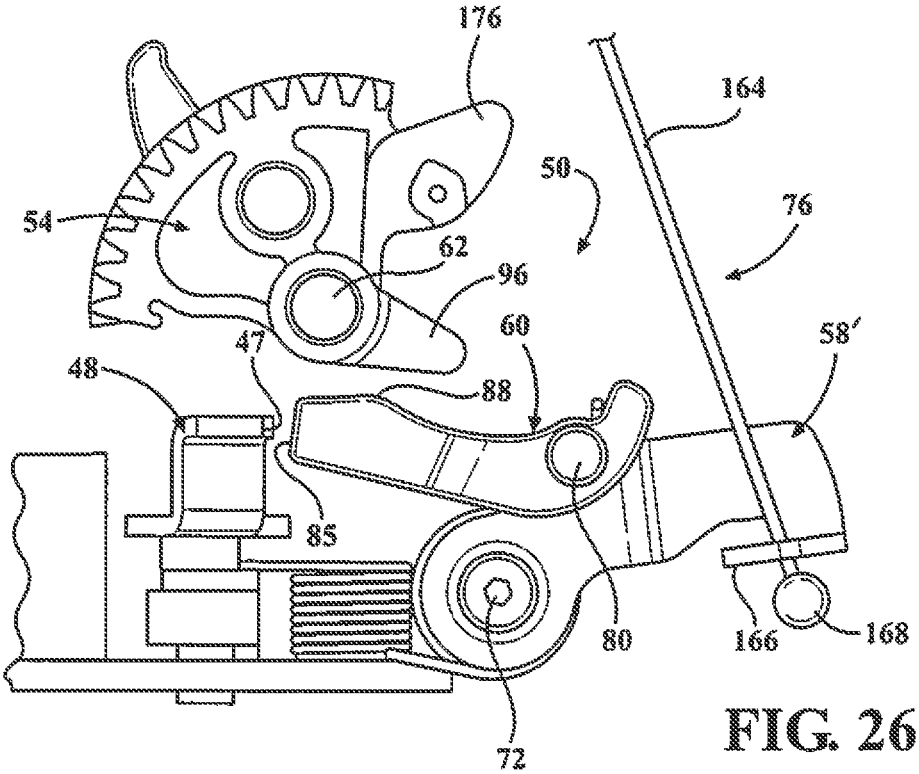
Figure 27:
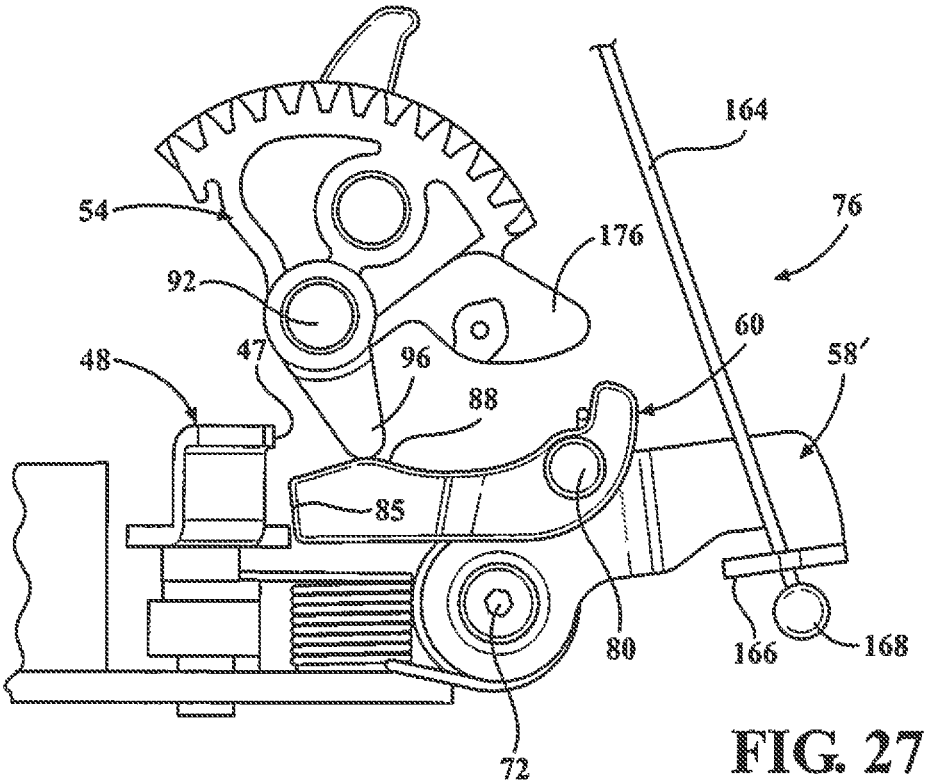
Figure 28:
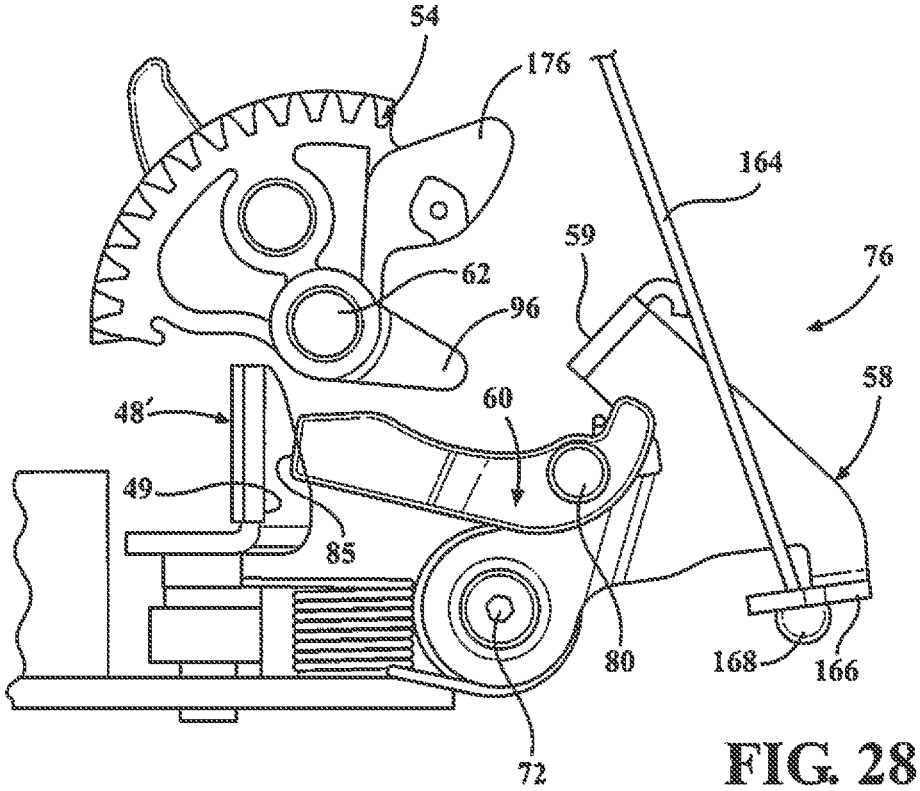
Figure 29:
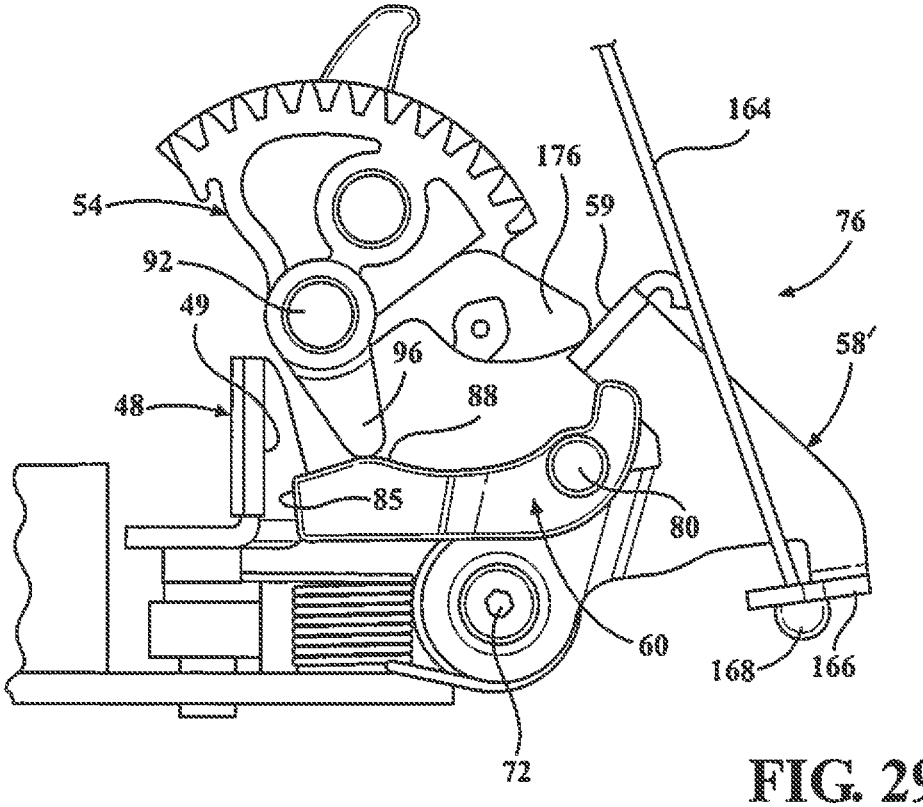
Figure 30:
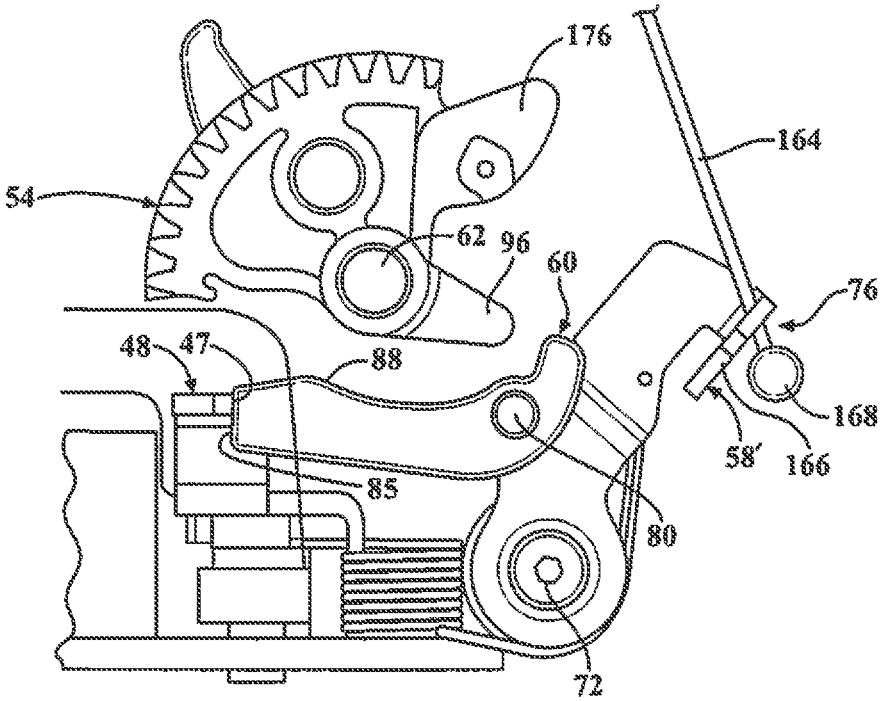
Figure 31:
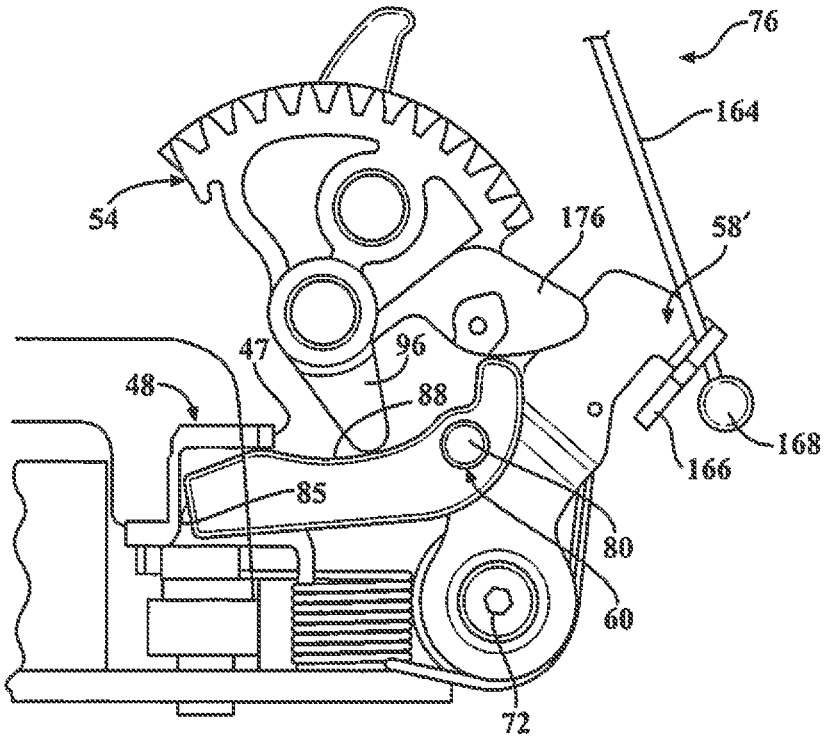
Figure 32:
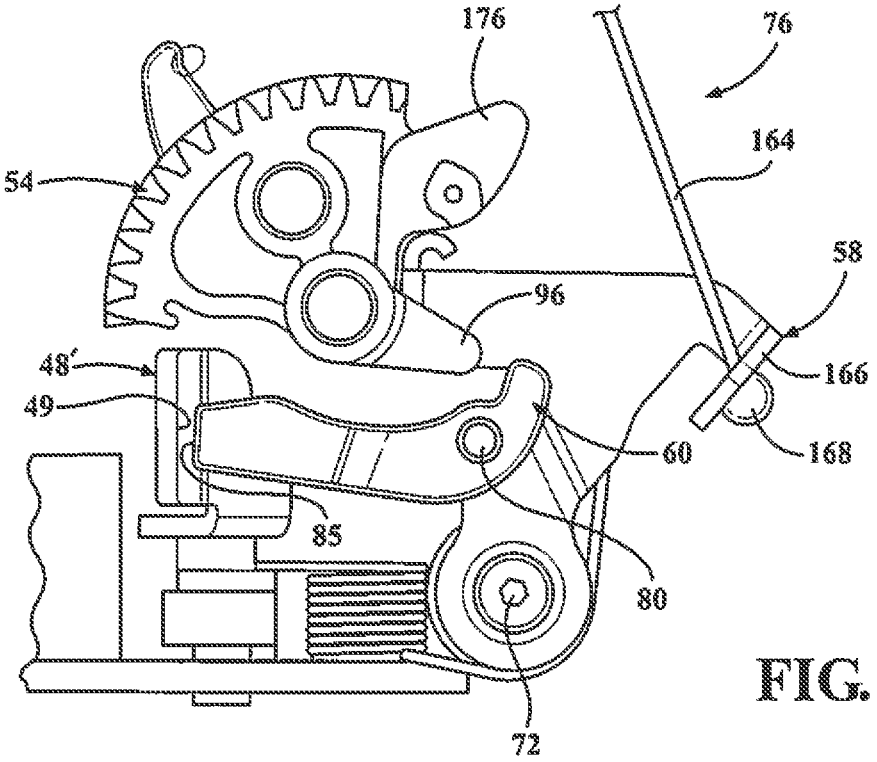
Figure 33:
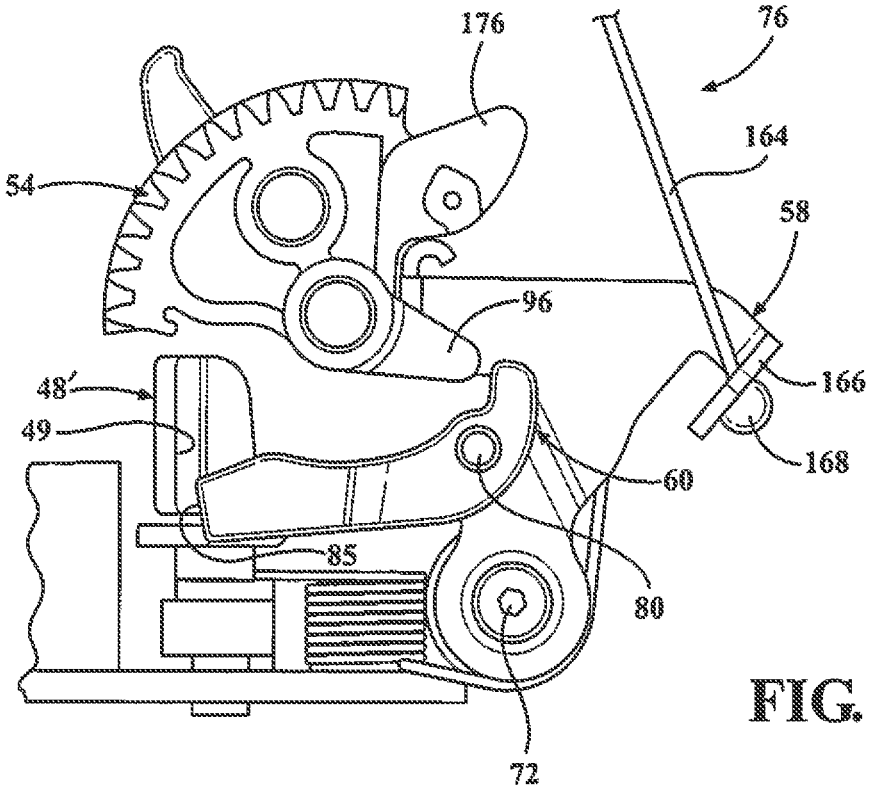
Figure 34:
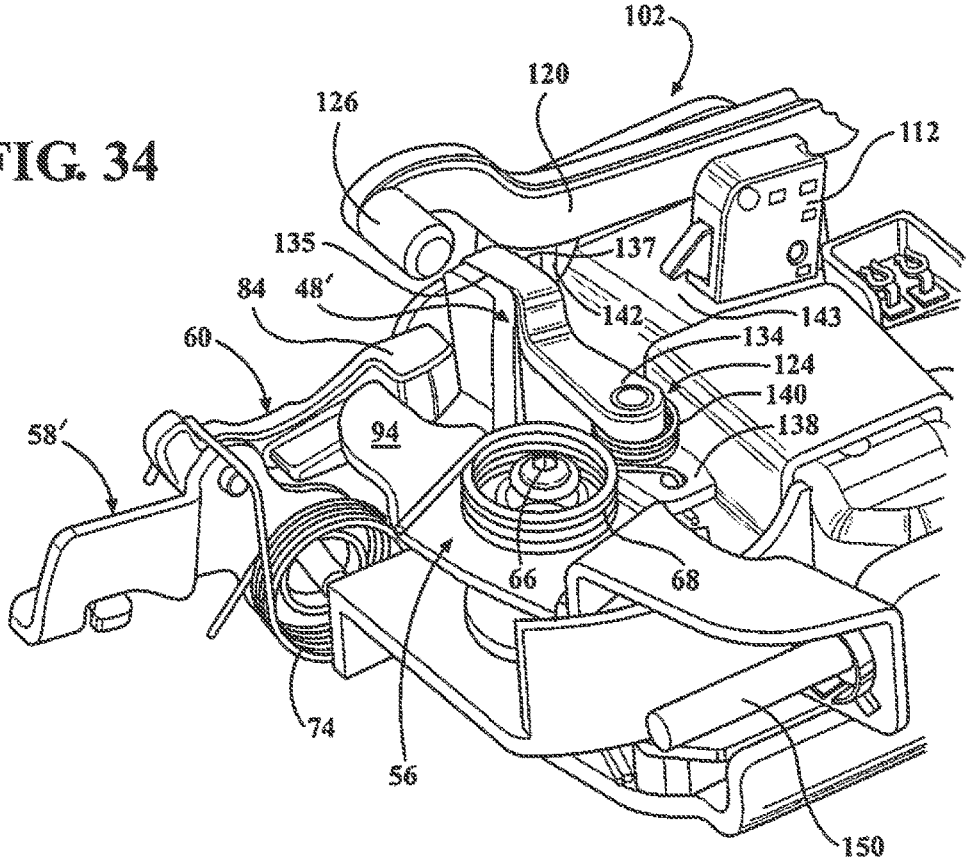
Figure 35:
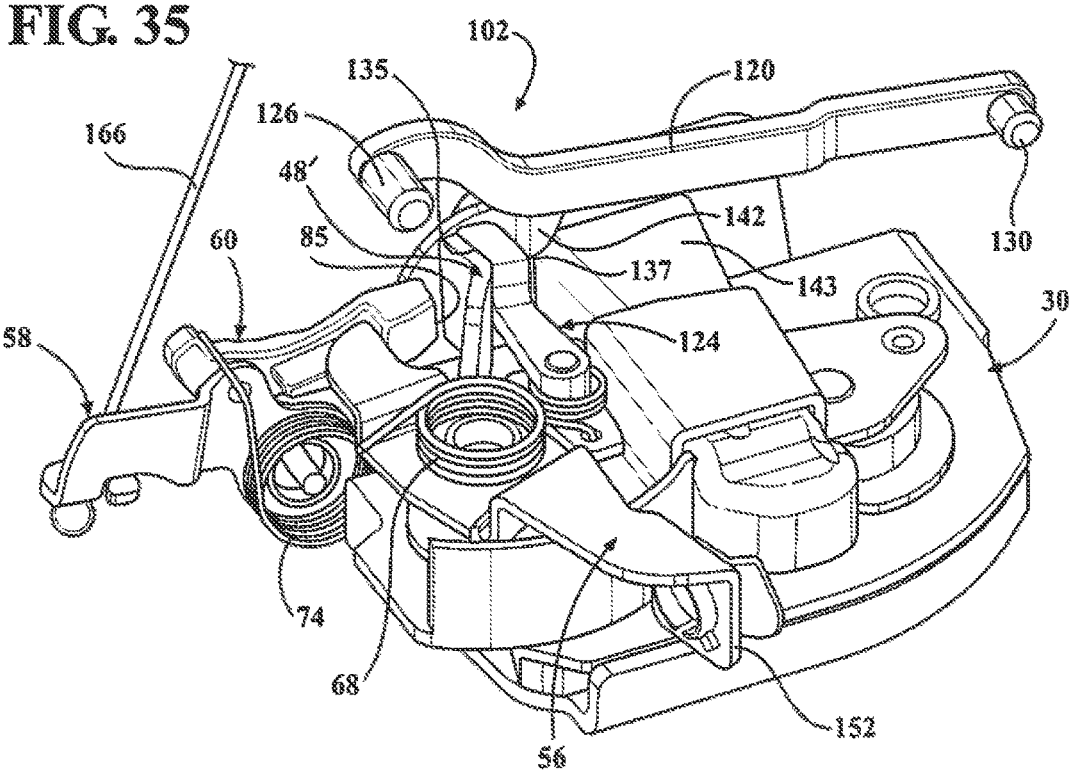
Figure 36:
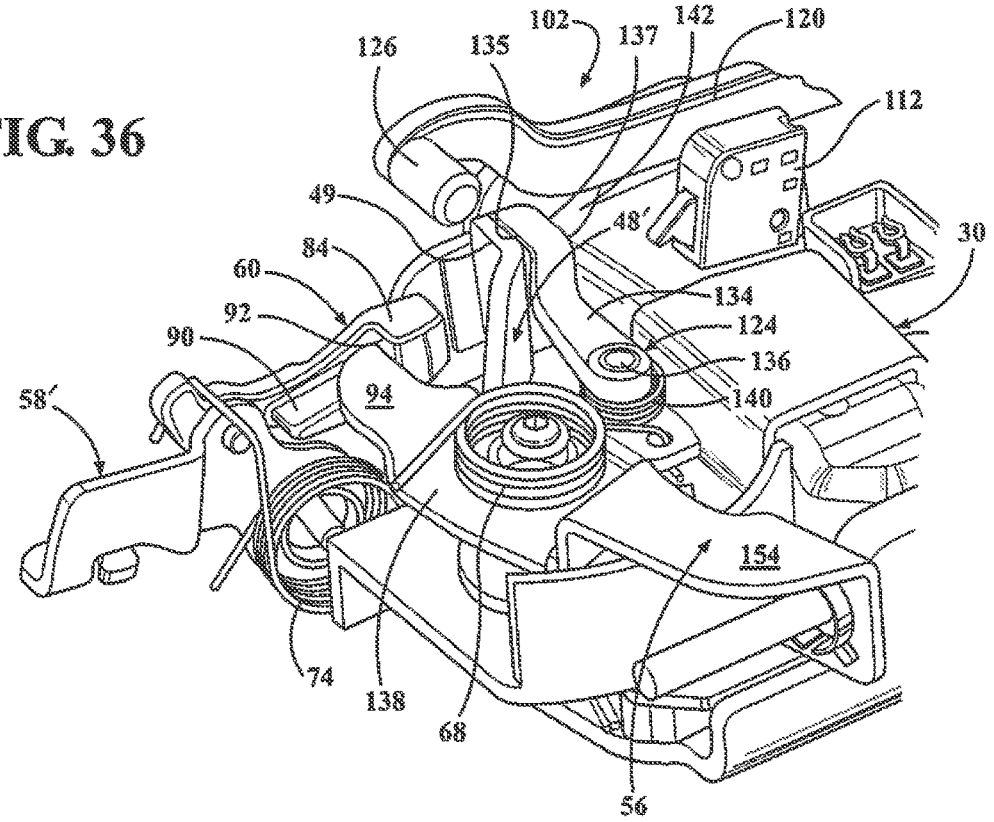
Figure 37:
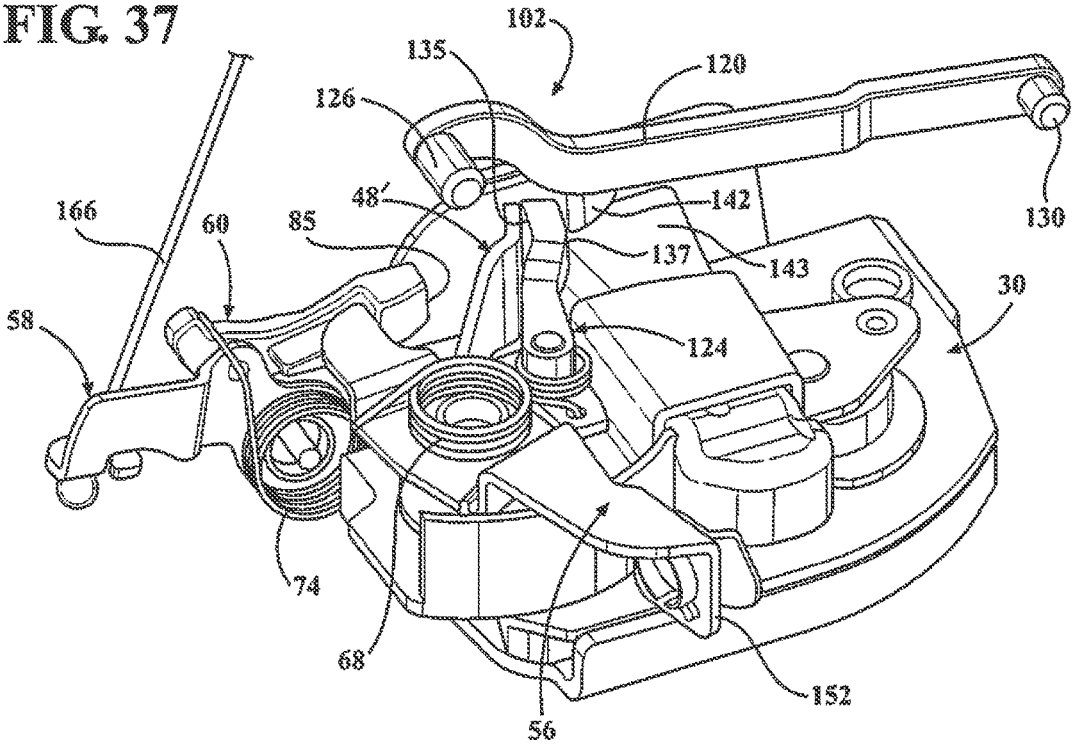

FIGS. 9A and 9B further illustrate components of the locking mechanism positioned to establish the Unlock mode and the Lock mode, respectively;

FIGS. 10 and 11 illustrate an embodiment of the locking mechanism operating in its Unlock mode in association with a "non-override" version of the latch mechanism;

FIGS. 12 and 13 are generally similar to FIGS. 10 and 11 but illustrate an embodiment of the locking mechanism operating in its Unlock mode in association with an "override" version of the latch mechanism;

FIGS. 14 and 15 illustrate the locking mechanism shown in FIGS. 10 and 11, respectively, now operating in its Lock mode;

FIGS. 16 and 17 illustrate the locking mechanism shown in FIGS. 12 and 13, respectively, now operating in its Lock mode;

FIGS. 18 and 19 are perspective views of components associated with an outside release mechanism having an outside release lever located in a "Rest" position while the locking mechanism is operating in its Unlock mode and the pawl is located in its ratchet hold position;

FIGS. 20 and 21 are perspective views of the outside release mechanism having the outside release lever located in its Rest position while the locking mechanism is operating in its Lock mode and the pawl is located in its ratchet hold position;

FIGS. 22 and 23 are perspective views that are generally similar to FIGS. 18 and 19, respectively, but which show the outside release lever located in a "Released" position while the locking mechanism is operating in its Unlock mode and the pawl is positioned in its ratchet release position;

FIGS. 24 and 25 are perspective views that are generally similar to FIGS. 20 and 21, respectively, but which show the outside release lever located in its Released position while the locking mechanism is operating in its Lock mode and the pawl is positioned in its ratchet hold position;

FIG. 26 is a side view of components of an inside release mechanism having an inside release lever located in a "Rest" position in association with the non-override version of the locking mechanism operating in its Unlock mode;

FIG. 27 is a side view showing the inside release lever located in its Rest position in association with the non-override version of the locking mechanism operating in its Lock position;

FIG. 28 is a side view of the inside release lever located in its Rest position in association with the override version of the locking mechanism operating in its Unlock mode;

FIG. 29 is a side view of the inside release lever located in its Rest position in association with the override version of the locking mechanism operating in its Lock mode;

FIG. 30 illustrates the inside release lever located in a "Released" position in association with the non-override version of the locking mechanism and showing a release link positioned to locate the pawl in its ratchet release position;

FIG. 31 illustrates the inside release lever located in its Released position in association with the non-override version of the locking mechanism and showing the release link positioned to locate the pawl in its ratchet hold position;

FIG. 32 illustrates the inside release lever located in its Released position in association with the override version of the locking mechanism and showing the release link positioned to locate the pawl in its ratchet release position;

FIG. 33 illustrates the inside release lever located in its Released position in association with the override version of the locking mechanism and showing the release link positioned to locate the pawl in its ratchet release position;

FIGS. 34 and 35 are perspective views illustrating various components of a key-less lock mechanism associated with the door latch assembly and operating in a "Lock" mode; and FIGS. 36 and 37 are perspective views generally similar to FIGS. 34 and 35, respectively, which show the key-less lock mechanism operating in an Unlock mode.

DETAILED DESCRIPTION

Example embodiments of a door latch assembly constructed in accordance with the present disclosure will now be more fully described. These example embodiments are generally directed to door latch assemblies having a locking mechanism equipped with a release link that is operably connected to an inside release lever instead of an outside release lever. Such an arrangement is advantageous in that it permits the vehicle door to be opened from the inside in the event that deformation of the outside door panel (i.e. due to a collision) interferes with release of the outside release lever. Moreover, each of the exemplary embodiments is provided so that this disclosure is thorough and fully conveys the scope of the inventive concepts, features and advantages to those skilled in the art. To this end, numerous specific details are set forth such as examples of specific components, devices and mechanisms associated with the door latch assemblies to provide a thorough understanding of each of the embodiments associated with the present disclosure. However, as will be apparent to those skilled in the art, not all specific details described herein need to be employed, the example embodiments may be embodied in many different forms, and that neither should be construed or interpreted to limit the scope of the disclosure.

Figure 1:
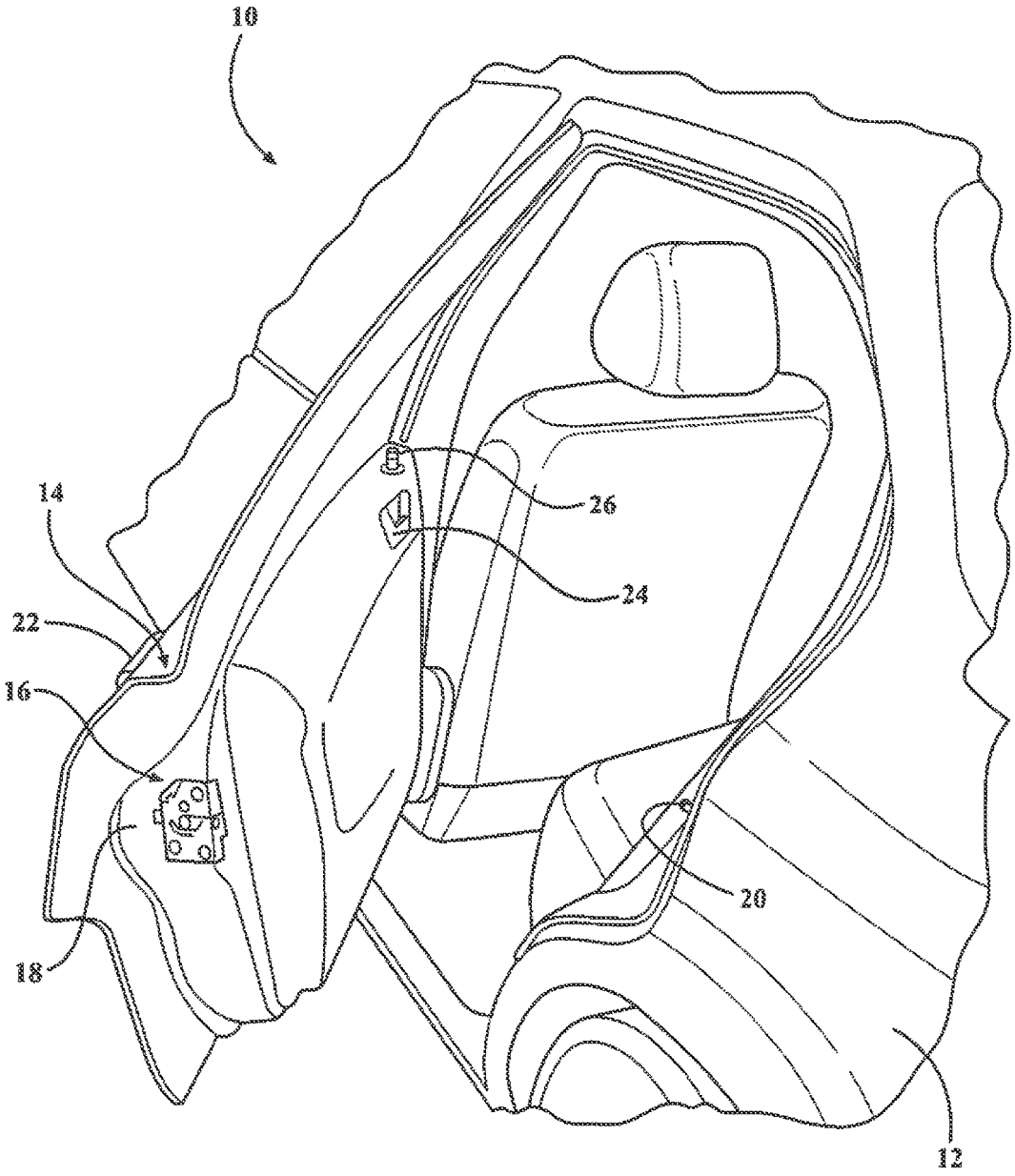
FIG. 1 is a perspective view of a motor vehicle having a passenger door equipped with a door latch assembly constructed in accordance with the teachings of the present disclosure.

FIG. 1 is a perspective view of a portion of a motor vehicle 10 having a vehicle body 12 and at least one door 14 that is adapted to move pivotally between open and closed positions relative to vehicle body 12. Door 14 includes a latch assembly 16 that is positioned adjacent an edge surface 18 and which is configured to be releasably engageable with a striker 20 mounted to body 12 for releasably holding door 14 in its closed position. An outside door handle 22 and an inside door handle 24 are provided to permit release of latch assembly 16 from striker 20 so as to allow door 14 to be swung to its open position. A lock knob 26 is shown in association with door 14 to provide a visual indication of the lock state of latch assembly 16 and which may be operably configured to switch the lock state of latch assembly 16 between an unlocked mode and a locked mode.

Figure 2A:
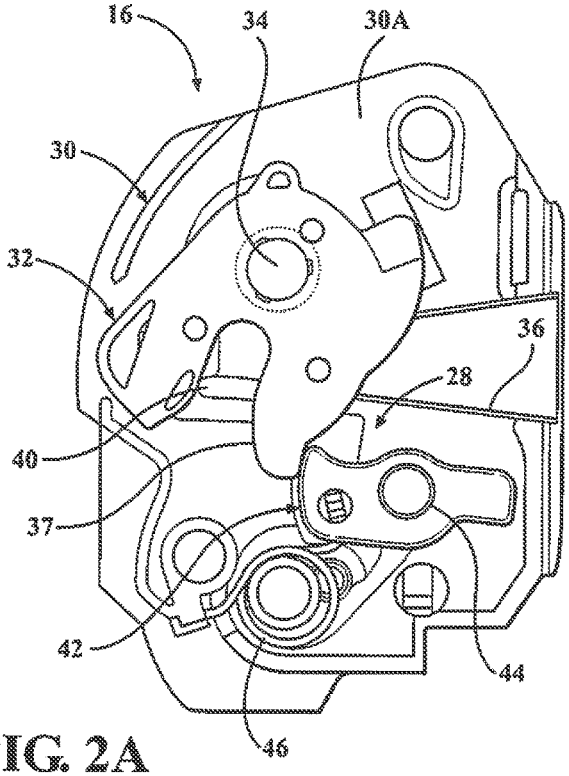
FIG. 2A-2C illustrate components of a latch mechanism associated with the door latch assembly of the present disclosure and which show a ratchet positioned in a striker capture position and a pawl positioned in a ratchet holding position.
Figure 2C:
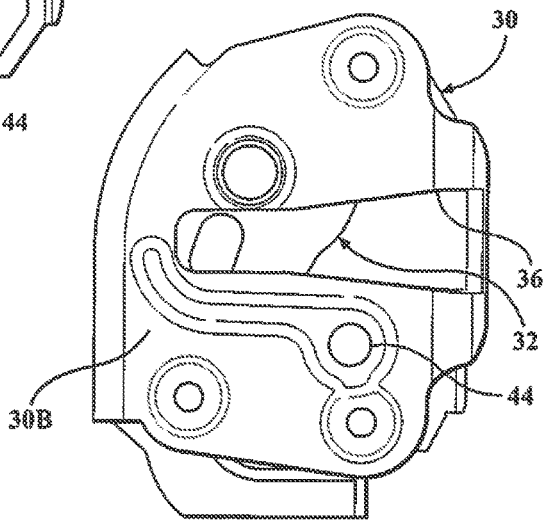
Figure 2B:
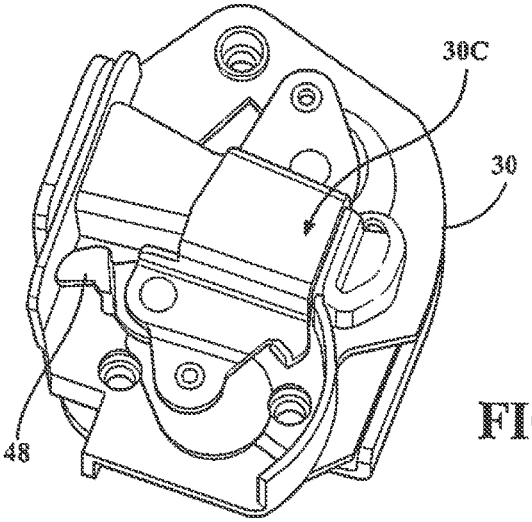
Figure 3A:
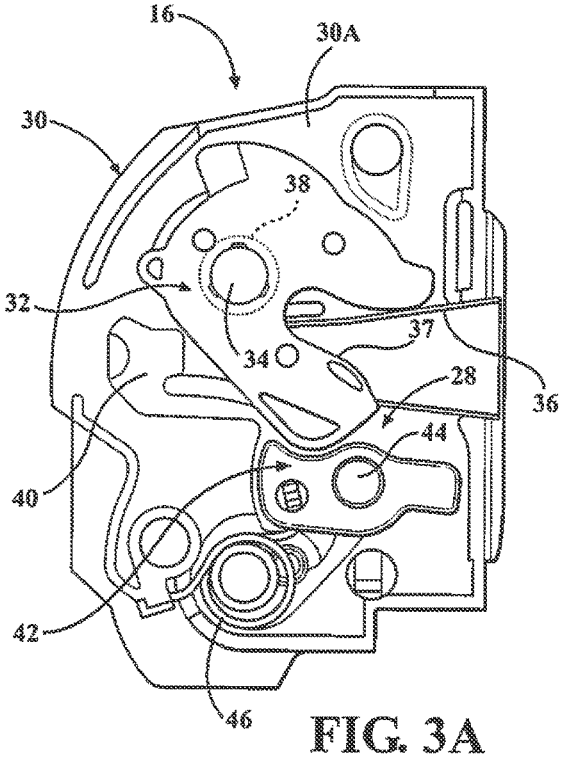
FIG. 3A-3C illustrates similar views to those of FIGS. 2A-2C with the exception that the latch mechanism is shown with the ratchet positioned in a striker release position and the pawl positioned in a ratchet release position.

Latch assembly 16 includes a multi-piece latch housing 30 having a latch plate 30A, a frame plate 30B, and a back plate 30C, as shown in FIGS. 2A-2C. Latch housing 30 is adapted to be rigidly secured to door 14 of vehicle 10. Latch plate 30A and frame plate 30B are interconnected to define a clam-shell type structural housing defining an internal chamber within which components of a latch mechanism 28 associated with latch assembly 16 are located. Specifically, latch mechanism 28 includes a ratchet 32 that is pivotally mounted by means of a ratchet pivot pin 34 for rotation about a ratchet pivot axis. Ratchet 32 is moveable between a first or striker capture position (FIG. 2A) and a second or striker release position (FIG. 3A). Ratchet 32 is operable in its striker capture position to retain striker 20 between a lock channel 37 formed in ratchet 32 and a fishmouth channel 36 formed in latch housing 30, thereby holding door 14 in its closed position. In contrast, ratchet 32 is operable in its striker release position to release striker 20 from retention within fishmouth channel 36 and permit subsequent movement of door 14 to its open position. Based on the views shown in FIGS. 2A and 3A, ratchet 32 rotates counterclockwise from its striker capture position into its striker release position. Ratchet 32 is normally biased toward its striker release position by a ratchet biasing member. Ratchet biasing member may be any suitable biasing device such as, for example, a ratchet torsion spring 38 that is mounted to generally surround pivot pin 34, as shown in FIG. 3A. A striker bumper 40 is secured to latch plate 30A (underneath ratchet 32) to cushion against the impact force of striker 20 when door 14 is closed. Latch assembly 16 is defined to be operating in a latched mode when ratchet 32 is held in its striker capture position and operating in an unlatched mode when ratchet 32 is released from its striker capture position.

Latch mechanism 28 associated with latch assembly 16 further includes a pawl 42 that is pivotally mounted to housing 30 via a pawl pivot pin 44 for rotation about a pawl pivot axis. Pawl 42 is pivotally moveable between a ratchet hold position (FIG. 2A) whereat pawl 42 retains ratchet 32 in its striker capture position and a ratchet release position (FIG. 3A) whereat pawl 42 permits movement of ratchet 32 to its striker release position. Based on the views shown in FIGS. 2A and 3A, pawl 42 rotates counterclockwise from its ratchet hold position toward its ratchet release position. Pawl 42 is normally biased toward its ratchet hold position by a pawl biasing member which may be any suitable biasing device such as, for example, a pawl torsion spring 46. While not limited to the arrangement shown, pawl torsion spring 46 is arranged to be offset from pawl pivot pin 44. Striker bumper 40 is also configured to act as a pawl bumper device (i.e. cushion the impact of the pawl as it transitions from its ratchet release position to its ratchet hold position).

Figure 3B:
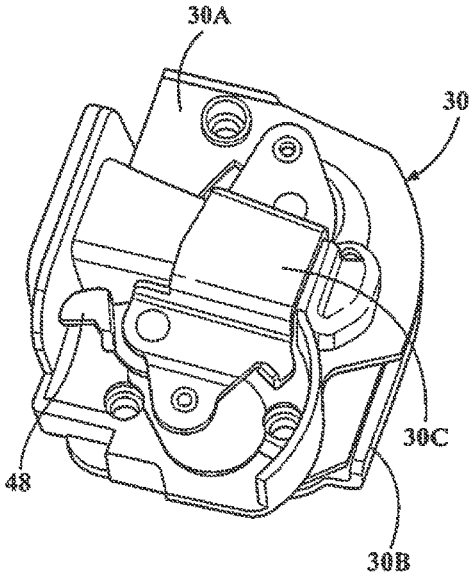
Figure 3C:
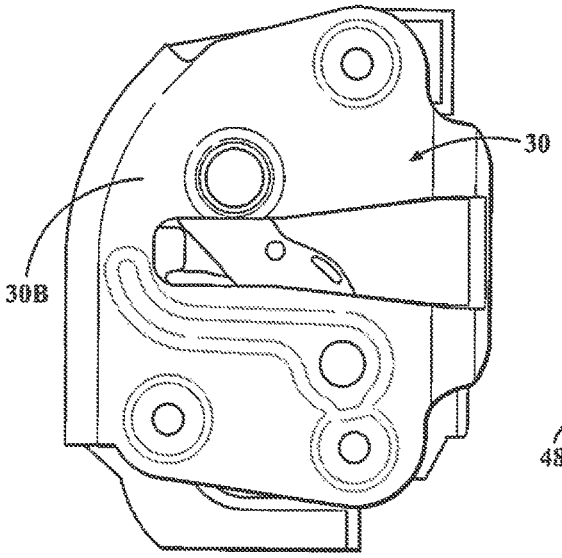
Figure 4:
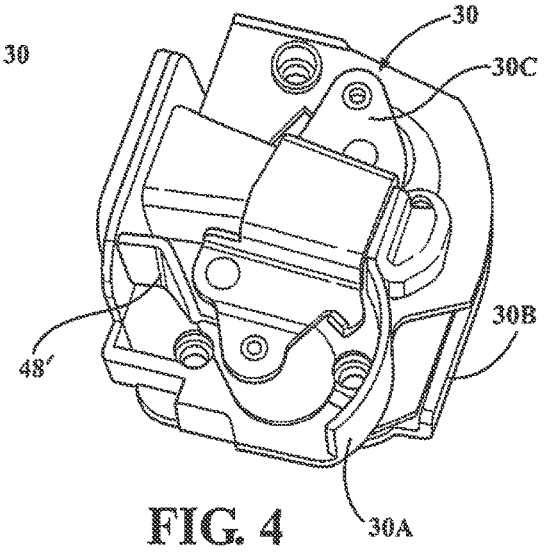
FIG. 4 is a perspective view generally similar to FIG. 3B but illustrating an alternative configuration for a latch mechanism having the pawl configured to provide an override function in cooperation with a locking mechanism associated with the door latch assembly of the present disclosure.

Pawl 42 also includes a pawl lever 48 which extends through a lost motion slot formed in latch plate 30A. FIGS. 2B and 3B illustrate a pawl lever 48 associated with a first or non-override version of latch assembly 28 that is configured for use with a locking mechanism to provide a standard or "non-override" inside release feature. In contrast, FIG. 4 illustrates an alternative configuration for a pawl lever 48' associated with a second or override version of latch assembly 28 and which is configured for use with a locking mechanism to provide an optional "override" or single pull inside release feature. The structure and operation of both versions of the locking mechanism will be described hereinafter with greater specificity.

Figure 5:
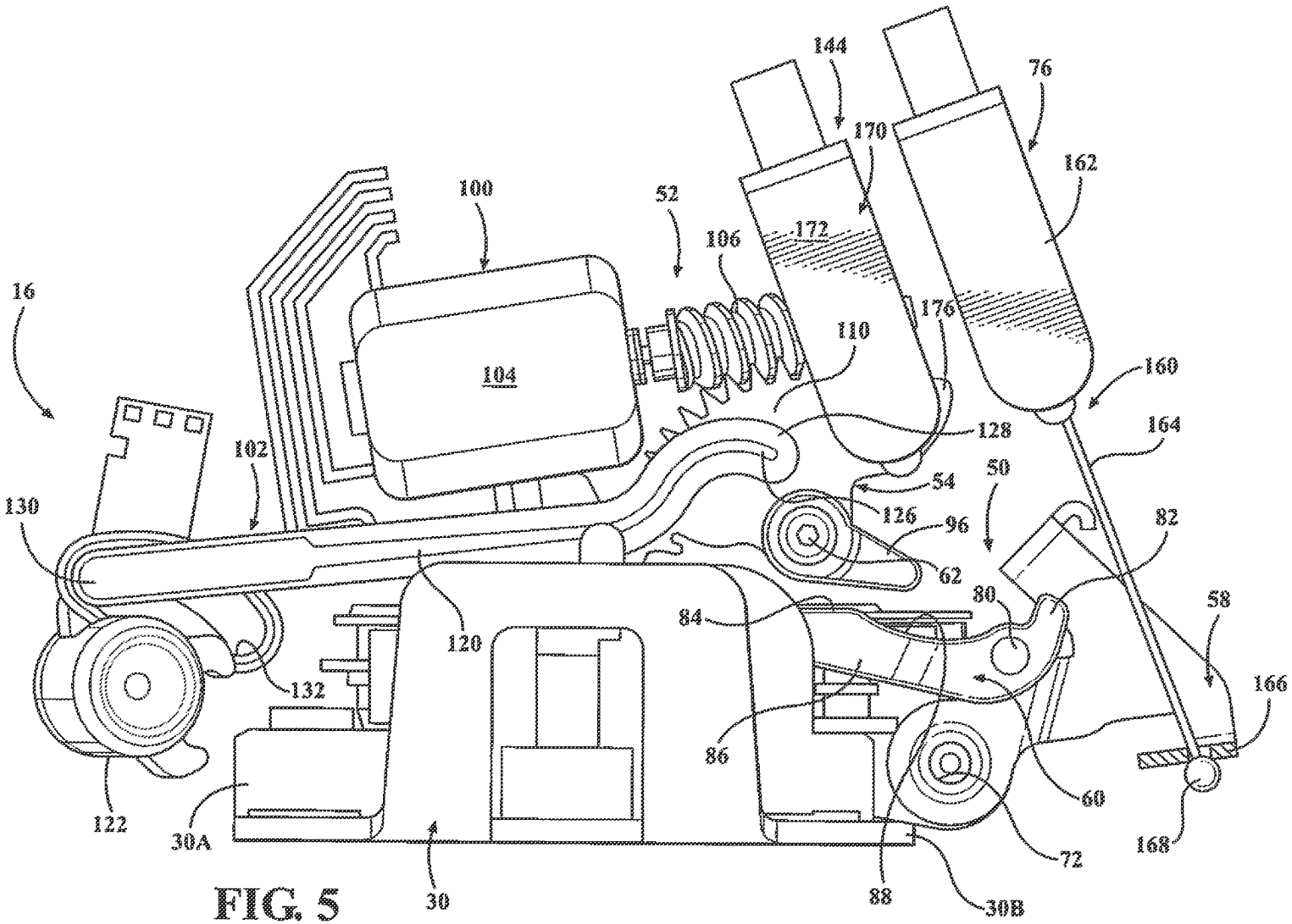
FIG. 5 illustrates various components of an operating mechanism and a locking mechanism associated with the door latch assembly of the present disclosure.
Figure 6:
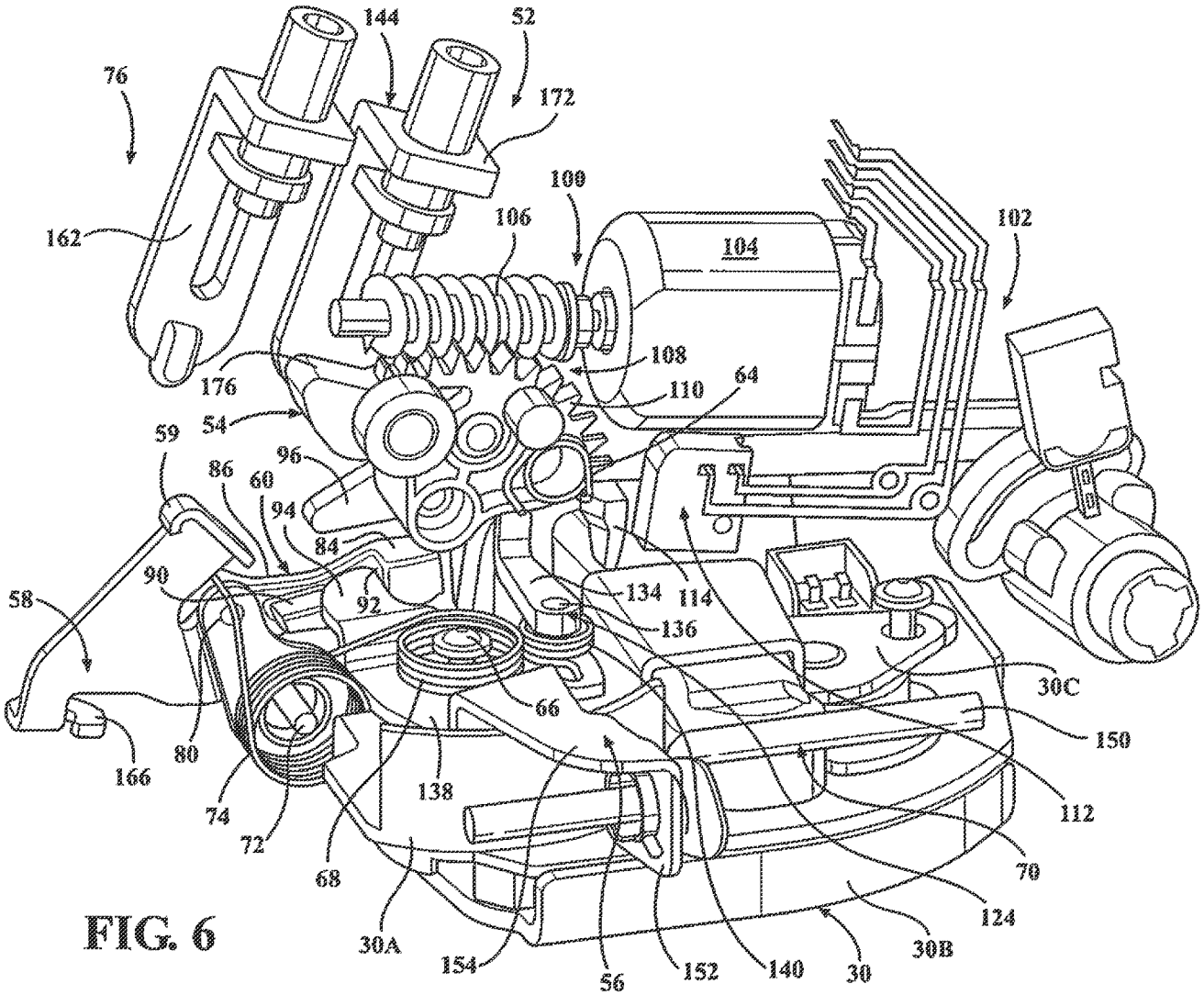
FIG. 6 is a perspective view further illustrating the components of the operating mechanism and the locking mechanism shown in FIG. 5 in association with an inside release mechanism and an outside release mechanism for the door latch assembly of the present disclosure.
Figure 7:
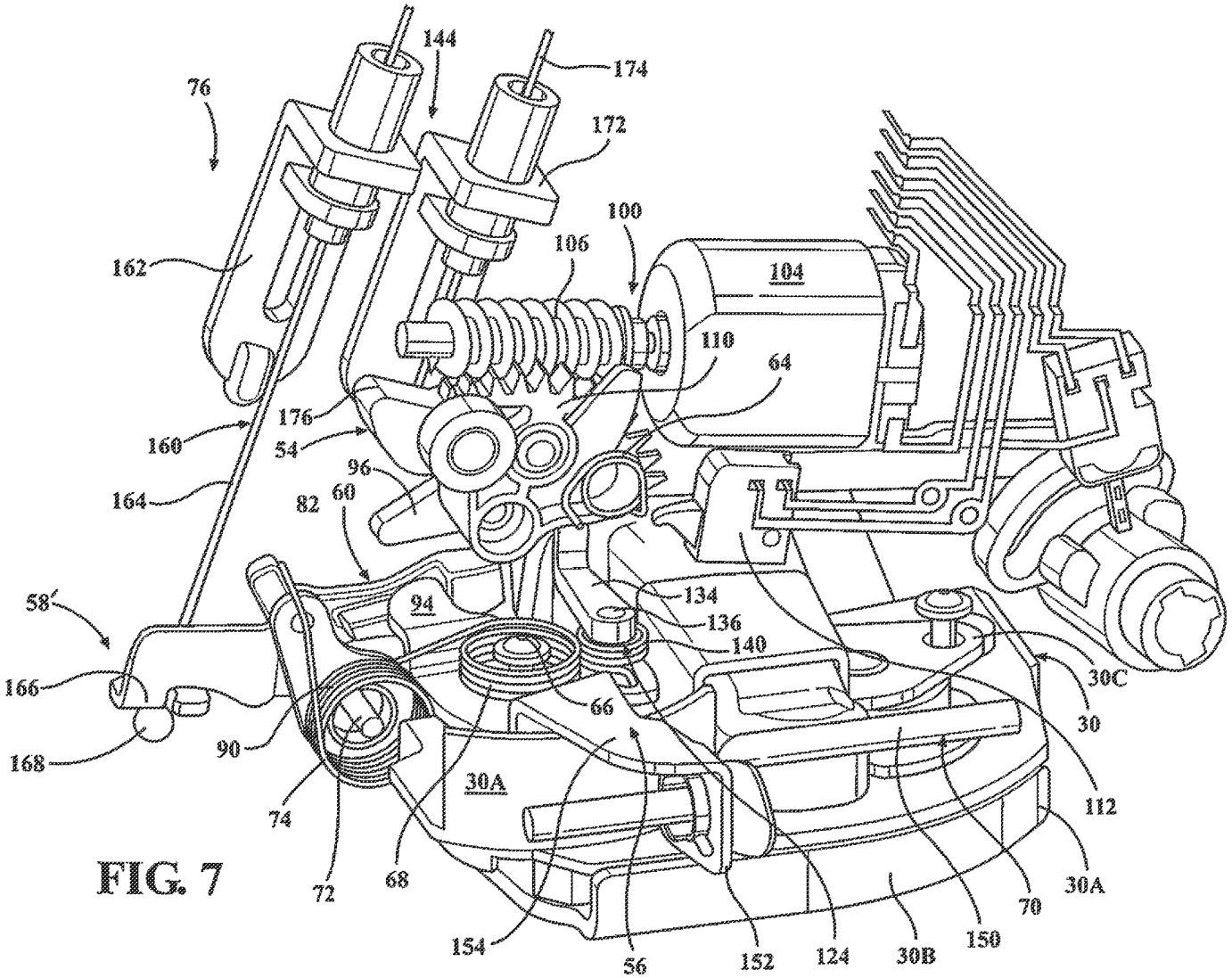
FIG. 7 is another perspective view illustrating components of the operating mechanism and the locking mechanism that are similar to those shown in FIG. 6.

Referring now initially to FIGS. 5 through 7, various components associated with a locking mechanism 50 and an operating mechanism 52 of latch assembly 16 will now be described. Generally speaking, locking mechanism 50 includes a lock gear 54, an outside release lever 56, an inside release lever 58 and a release link 60. Lock gear 54 is pivotally mounted to latch housing 30 via a pivot post 62 for rotation about a lock gear pivot axis. Lock gear 54 is pivotable between a first or "Non-Actuated" position and a second or "Actuated" position. A bi-stable or two-position biasing member, such as a lock gear toggle spring 64, acts between housing 30 and lock gear 54 to positively locate lock gear 54 in one of its two distinct operating positions. Outside release lever 56 is pivotally mounted to housing 30 via a pivot post 66 for rotation about an outside release lever pivot axis. Outside release lever 56 is pivotally moveable between a first or "Rest" position and a second or "Released" position. Outside release lever 56 is normally biased toward its Rest position via an outside release lever biasing member such as, for example, an outside release torsion spring 68. Outside release torsion spring 68 is shown to be concentrically mounted relative to pivot post 66 and has a first end acting on outside release lever 56 and a second end acting against housing 30. As will be detailed later, an outside release mechanism 70 is provided for interconnecting outside release lever 56 to outside door handle 22 such that activation of outside door handle 22 functions to move outside release lever 56 from its Rest position into its Released position in opposition to the biasing exerted by outside release torsion spring 68.

Inside release lever 58 is also pivotally mounted to housing 30 via a pivot post 72 for rotation about an inside release lever pivot axis. Inside release lever 58 is pivotally moveable between a first or "Rest" position and a second or "Released" position. Inside release lever 58 is normally biased toward its Rest position via an inside release lever biasing member such as, for example, an inside release torsion spring 74. A first end of inside release torsion spring 74 engages inside release lever 58 and a second end acts against housing 30. Inside release torsion spring 74 is shown to concentrically surround pivot post 72. As will be detailed later, an inside release mechanism 76 interconnects inside release lever 58 to inside door handle 24 such that activation of inside door handle 24 functions to move inside release lever 58 from its Rest position into its Released position in opposition to the biasing exerted by inside release torsion spring 74.

Release link 60 is shown aligned generally parallel to inside release lever 58 and is pivotally connected to inside release lever 58 via a pivot post 80 for rotation about a release link pivot axis. Release link 60 is configured to define a first end segment 82, a second end segment 84 and an elongated intermediate segment 86 therebetween. Intermediate segment 86 defines an external cam surface 88 and a recessed guide slot 90 having a stop shoulder 92. Release link 60 is pivotally moveable relative to inside release lever 58 between a first or Unlock position and a second or Lock position. First end segment 82 of release link 60 is fixed via pivot post 80 to inside release lever 58 while the first end of inside release torsion spring 74 engages release link 60 for normally biasing release link 60 toward its Unlock position. Release link 60 is also moveable between a first or "Retracted" position and a second or "Extended" position relative to pawl lever 48, 48' in response to movement of inside release lever 58 between its Rest and Released positions. As will be detailed hereinafter with greater specificity, a drive flange 94 extending from outside release lever 56 can, under certain operating circumstances, be located within guide slot 90 and be in engagement with stop shoulder 92. Additionally, a drive cam projection 96 extending from lock gear 54 can, during certain operational circumstances, move into and out of engagement with external cam surface 88 on release link 60 for moving release link 60 between its Unlock and Lock positions.

With continued reference to FIGS. 5 through 7, operating mechanism 52 is generally shown to include a power-operated actuator unit 100 for moving lock gear 54 between its Non-Actuated and Actuated positions, and a key-less lock mechanism 102. The power-operated actuator unit 100 includes an electric motor 104 having a rotary output driving a worm 106 of a worm gearset 108. Worm gearset 108 also includes a worm gear 110 driven by worm 106 and which is rigidly fixed to, or integrally formed on, lock gear 54. As such, controlled rotation of worm 106 in a first rotary direction causes rotary movement of lock gear 54 in a first direction from its Non-Actuated position toward its Actuated position. Likewise, rotation of worm 106 in a second rotary direction causes rotary movement of lock gear 54 from its Actuated position toward its Non-Actuated position. A lock status switch 112 can be selectively activated by engagement with a switch tab projection 114 mounted to lock gear 54 to provide a signal to a centralized door lock control system (not shown) indicative of the rotated position of lock gear 54. As is known, the door lock control system can be configured to control selective actuation of electric motor 104.

Key-less lock mechanism 102 includes an elongated key lock link 120, a key lock knob 122, and a spring-biased key-less lock lever assembly 124. A first pivot post 126 formed on a first end of key lock link 120 is journalled in an aperture 128 formed in lock gear 54 while a second pivot post 130 formed on a second end of key lock link 120 is retained in a lost-motion slot 132 formed in key lock knob 122. Spring-biased key-less lock lever assembly 124 includes a lock lever 134 pivotally mounted via a pivot post 136 formed on a central flange section 138 of outside release lever 56, and a lock lever torsion spring 140 which surrounds pivot post 136 and normally biases a first surface 135 of lock lever 134 into engagement with pawl lever 48'. Lock lever 134 also includes a second surface 137 which engages a cam segment 142 formed on key lock link 120. Cam segment 142 on key lock link 120 is adapted to engage a cam surface 143 formed on housing 30 in response to movement of lock link 120. In addition, a lock release mechanism 144 operatively interconnects lock gear 54 to lock knob 26 located on the inside sill panel of door 14.

Outside release mechanism 70 is shown to include a pushrod 150 that is coupled to a transverse flange section 152 of outside release lever 56. Flange section 152 extends from a raised flange section 154 that is interconnected to central flange section 138. It will be appreciated that any suitable combination of components including pushrod 150, linkages and/or cables can be employed in association with outside release mechanism 70 to operatively interconnect outside release lever 56 to outside door handle 22 of door 14. Likewise, inside release mechanism 76 is shown to include a release cable assembly 160 having a cable guide member 162 and a release cable 164. A ferrelled end 168 of release cable 164 engages a flange section 166 formed on inner release lever 58. Again, those skilled in the art will appreciate that any suitable combination of elements operable for connecting inside release lever 58 to inside door handle 24 of door 14 can be utilized. Finally, door latch assembly 16 is also shown to include a lock gear release cable assembly 170 in association with lock release mechanism 144 having a cable guide member 172 and a release cable 174 having one end secured to a guide flange 176 formed on lock gear 54.

Figure 8A:
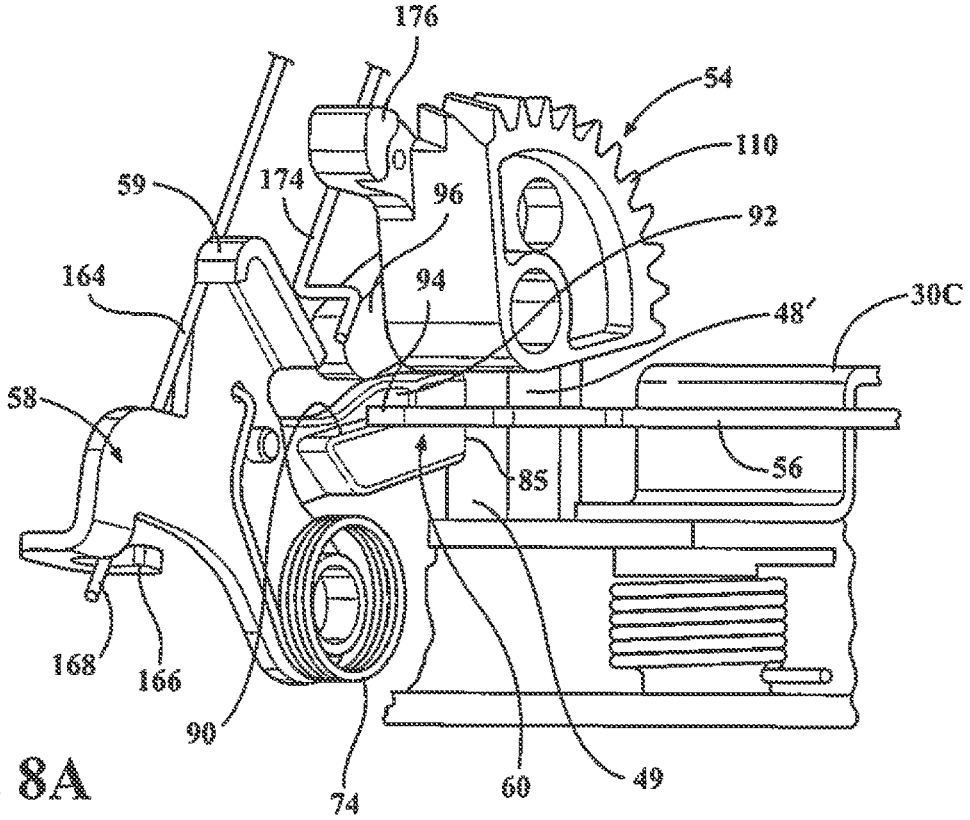
FIGS. 8A and 8B illustrate components of the locking mechanism positioned to respectively establish an "Unlock" mode and a Lock mode.
Figure 8B:
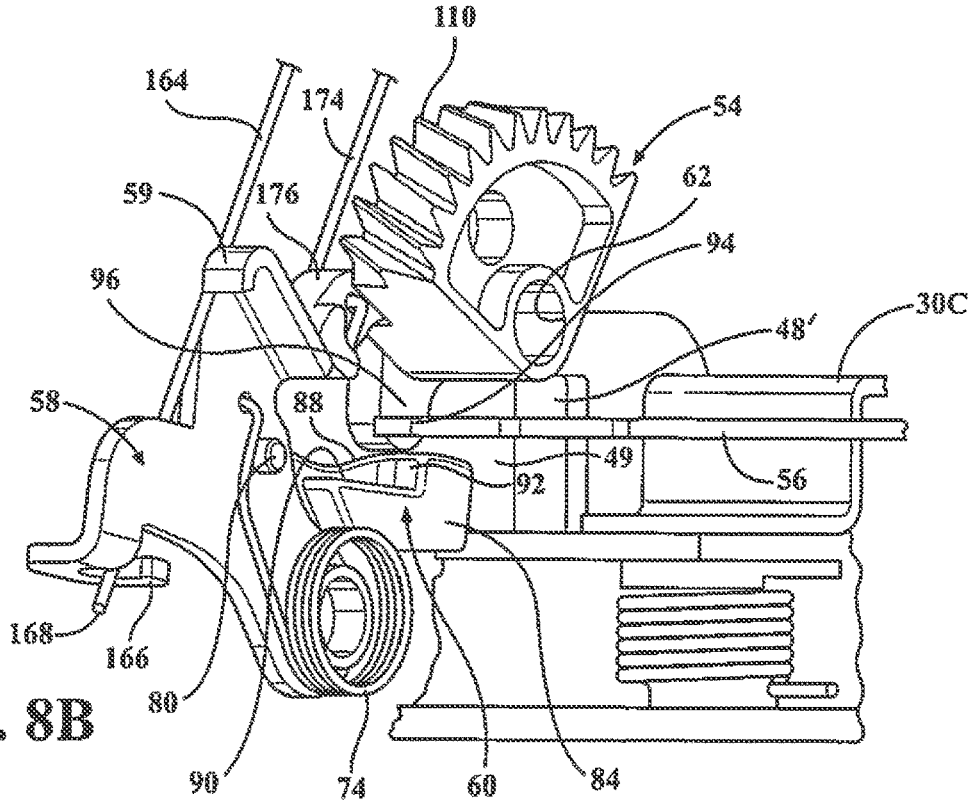

With the general arrangement of components associated with latch assembly 16 having been shown and described with sufficient detail, the various operative interconnections, positions and modes associated with latch assembly 16 will now be the primary focus of the remaining disclosure. In general, FIG. 8A illustrates locking mechanism 50 with its components positioned to establish a first or "Unlock" operating mode while FIG. 8B illustrates locking mechanism 50 with its components positioned to establish a second or "Lock" operating mode. Note that FIGS. 8A and 8B illustrate latch mechanism 28 equipped with override pawl lever 48' of FIG. 4.

To establish the Unlock mode of locking mechanism 50 (FIG. 8A), lock gear 54 is located in its Non-Actuated position, outside release lever 56 is located in its Rest position, inside release lever 58 is located in its Rest position, and release link 80 is located in its Unlock and Retracted position. Accordingly, drive flange 94 of outside release lever 56 is located in guide slot 90 of release link 60 and engages stop shoulder 92. In addition, cam projection 96 on lock gear 54 is shown displaced from engagement with external cam surface 88 of release link 60. An engagement face surface 85 formed on second end segment 84 of release link 60 extends a first length dimension and is shown positioned in close proximity to an elongated engagement face surface 49 of override pawl lever 48' that extends a second length dimension while pawl 42 is shown maintained in its ratchet hold position. The second length dimension of engagement face surface 49 is greater than the first length dimension of engagement face surface 85 of the release link 60.

To establish the Lock mode of locking mechanism 50 (FIG. 8B), lock gear 54 is rotated to its Actuated position such that cam projection 96 engages external cam surface 88 and causes release link 60 to pivot about pivot post 80 from its Unlock and Retracted position shown in FIG. 8A to its Lock and Retracted position shown in FIG. 8B. As a result of such pivotal movement of release link 60, drive flange 94 on outside release lever 56 exits guide slot 90 and loses contact with stop shoulder 92 of release link 60. However, engagement face surface 85 formed on second end segment 84 of release link 60 is maintained in close proximity to engagement face surface 49 of override pawl lever 48' while pawl 42 is still maintained in its ratchet hold position. As seen, a flange portion 176 of lock gear 54 may engage a support flange 59 formed on inside release lever 58 when lock gear 54 is rotated to its Actuated position and inside release lever 58 is maintained in its Rest position.

FIGS. 9A and 9B are generally similar to FIGS. 8A and 8B in that they respectively illustrate locking mechanism 50 in its Unlock and Lock operating modes. However, the difference is directed to latch assembly 28 employing non override pawl lever 48 (FIGS. 2B and 3B). A slightly revised version of inside release lever 58' may be used with the non-override version of locking mechanism 50. As such, in the Unlock mode shown in FIG. 9A, locking mechanism 50 is shown with engagement face surface 85 on second end segment 84 of release link 60 positioned in close proximity to an engagement edge surface 47 of pawl lever 48 while pawl 42 is maintained in its ratchet hold position. Thus, release link 60 is located in its Unlock and Retracted position such that drive flange 94 of outside release lever 56 is in contact with stop shoulder 92 of release link 60. In contrast, the Unlock mode shown in FIG. 9B results from rotation of lock gear 54 from its Non-Actuated position into its Actuated position which causes release link 60 to pivot from its Unlock and Retracted position into its Lock and Retracted position. Engagement edge surface 47 extends axially along the pawl pivot axis a third length dimension which is less than the first length dimension of engagement face surface 85 of release link 60. Accordingly, with release link 60 in its Lock and Retracted position, drive flange 94 of outside release lever 56 is released from guide slot 90 and loses contact with stop shoulder 92 while engagement face surface 85 on second end segment 84 of release link 60 is now located below and out of alignment with respect to engagement edge surface 47 of pawl lever 48.

FIGS. 10 and 11 provide additional illustrations of the non-override version of locking mechanism 50 with its components positioned to establish the Unlock mode while FIGS. 14 and 15 provide similar illustrations for this non-override version of locking mechanism 50 with its components operably positioned to establish the Lock mode. In contrast, FIGS. 12 and 13 provide additional illustrations of the override version of locking mechanism 50 operating in its Unlock mode while FIGS. 16 and 17 illustrate the override version of locking mechanism 50 operating in its Lock mode.

Referring primarily now to FIGS. 18 and 19, the non-override version of locking mechanism 50 is shown operating in its Unlock mode with outside release lever 56 in its Rest position, inside release lever 58 in its Rest position, and release link 60 in its Unlock and Retracted position. Similarly, FIGS. 20 and 21 illustrate the non-override version of locking mechanism 50 operating in its Lock mode with both outside release lever 56 and inside release lever 58 in their respective Rest positions and release link 60 pivoted by lock gear 54 to its Lock and Retracted position. As such, these illustrations provide details of the interaction of the components of locking mechanism 50 when outside release mechanism 70 and inside release mechanism 76 are in a non-actuated mode of operation such that pawl 42 is maintained in its ratchet hold position.

Referring to FIGS. 22 and 23, outside release mechanism 70 is shown actuated in response to movement of outside handle 22 for causing movement of outside release lever 56 from its Rest position (FIGS. 18 and 19) into its Released position while locking mechanism 50 is operating in its Unlock mode. As noted, outside release mechanism 70 includes, in this non-limiting example, a pushrod 150 configured to operably connect outside release lever 56 to outside door handle 22. As seen, such pivotal movement of outside release lever 56 has caused drive flange 94 on outside release lever 56 to forcibly engage stop shoulder 92 of release link 60 and cause forward sliding movement of release link 80 from its Unlock and Retracted position into its Unlock and Extended position (i.e., "Pawl Release" position), whereby its engagement face surface 85 engages edge surface 47 of pawl lever 48 and causes pawl 42 to move from its ratchet hold position into its ratchet release position. In this manner, door 14 may be opened via manual actuation of outside door handle 22. Thus, FIGS. 22 and 23 illustrate outside release of latch assembly 16 when locking mechanism 50 is in its Unlock mode. In contrast, FIGS. 24 and 25 illustrate locking mechanism 50 operating in its Lock mode when outside release lever 56 has been rotated to its Released position. However, drive flange 94 of outside release lever 56 is shown displaced from engagement with release link 60 shown in its Lock and Retracted position. As such, movement of outside release lever 56 to its Released position does not result in movement of release link 60 to its Pawl Release position. In addition, drive flange 94 does not engage edge surface 47 of pawl lever 48 such that pawl 42 is maintained in its ratchet hold position. It is noted that inside release lever 58 is maintained in its Rest position during movement of outside release lever 56 between its Rest and Released positions when locking mechanism 50 is in its Lock mode.

Referring now to FIGS. 26-33, the various operating positions and modes of locking mechanism 50 associated with inside release mechanism 76 moving inside release lever 58 between its Rest and Released positions in response to actuation of inside door handle 24 will now be described. In general, FIGS. 26 and 27 illustrate the non-override version of locking mechanism 50 in its Unlock and Lock modes, respectively, when inside release lever 58 is located in its Rest position. More specifically, FIG. 26 shows release link 60 positioned in its Unlock and Retracted position when inside release lever 58' is located in its Rest position while FIG. 27 shows release link 60 positioned in its Lock and Retracted position with inside release lever 58' in its Rest position. Likewise, FIGS. 30 and 31 illustrate the non-override version of locking mechanism 50 in its Lock and Unlock modes, respectively, when inside release lever 58' has been pivoted from its Rest position into its Released position upon actuation of inside release mechanism 76. Specifically, FIG. 30 shows release link 60 positioned in its Unlock and Extended position when inside release lever 58' is located in its Released position while FIG. 31 shows release link 60 positioned in its Lock and Extended position when inside release lever 58' is in its Released position. As noted, a non-limiting version of inside release mechanism 76 includes a release cable assembly 160 operably interconnecting inside release lever 58' for movement with inside door handle 24.

In FIG. 26, release link 60 is shown located in its Unlock and Retracted position such that engagement face surface 85 is aligned with edge surface 47 of pawl lever 48 while pawl 42 is maintained in its ratchet hold position. In contrast, FIG. 27 illustrates release link 60 pivotably driven to its Lock and Refracted position via rotation of lock gear 54 to its Actuated position. Note that engagement face surface 85 of release link 60 is now oriented to extend below edge surface 47 of pawl lever 48. FIG. 30 shows that rotation of inside release lever 58 about its pivot post 72 from its Rest position to its Released position also causes release link 60 to move from its Unlock and Retracted position into its Pawl Release position, thereby causing engagement face surface 85 to engage edge surface 47 of pawl lever 48 and forcibly move pawl 42 into its ratchet release position. This sequence of drawings illustrates the permitted inside release of latch assembly 28 via actuation of inside door handle 24 and inside release mechanism 76. However, FIG. 31 shows that actuation of inside release mechanism 76 to move inside release lever 58 to its Released position does not cause movement of pawl 42 to its ratchet release position when locking mechanism 50 is in its Lock mode since movement of release link 60 to its Lock and Extended position does not result in engagement of face surface 85 with edge surface 47 of pawl lever 48.

FIGS. 28 and 29 illustrate the override version of locking mechanism 50 in its Unlock and Lock modes, respectively, when inside release lever 58 is located in its Rest position. Specifically, FIG. 28 shows release link 60 in its Unlock and Retracted position with inside release lever 58 in its Rest position while FIG. 29 shows release link 60 in its Lock and Retracted position with inside release lever 58 in its Rest position. Likewise, FIGS. 32 and 33 illustrate the override version of locking mechanism 50 in its Unlock and Lock modes, respectively, when inside release lever 58 has been rotated to its Released position upon actuation of inside release mechanism 76. Specifically, FIG. 32 shows release link 60 in its Unlock and Extended position with inside release lever 58 in its Released position while FIG. 33 shows release link 60 it its Lock and Extended position while inside release lever 58 is in its Released position. As is clearly seen, the enlarged engagement surface 49 associated with pawl lever 48' facilitates engagement of engagement face surface 85 on release link 60 (FIGS. 32 and 33) therewith for causing movement of pawl 42 to its ratchet release position.

Referring generally now to FIGS. 34-37, the functional and structural features of key-less lock mechanism 102 will now be detailed. In particular, FIGS. 34 and 35 illustrate the components of key-less lock mechanism 102 arranged to define a "Lock" mode while FIGS. 36 and 37 illustrate the same components arranged to define an "Unlock" mode. The Lock mode is established with pawl 42 in its ratchet hold position such that first surface 135 of lock lever 134 is biased into engagement with pawl lever 48' and cam segment 142 on key lock link 120 is disposed between second surface 137 of lock lever 134 and cam surface 143 of housing 30. Due to the pivotal connection of post 126 within aperture 128, key lock link 120 is located in a first or Locked position when lock gear 54 is located in its Actuated position. Upon movement of pawl 42 from its ratchet hold position into its ratchet release position, lock lever 134 rotates about pivot post 126 and the ramming action between cam segment 142 on key lock link 120 and cam segment 143 of housing 30 causes lock link 120 to move into a second or Unlock position which, in turn, drives lock gear 54 to its Non-Actuated Position. The lost motion slot 132 in key lock knob 122 accommodates movement of lock link 120. A key lock switch provides signals indicative of the rotated position of key lock knob 122.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A vehicle door latch assembly, comprising:

a housing;

a ratchet moveable within said housing between a striker capture position wherein said ratchet is positioned to retain a striker and a striker release position wherein said ratchet is positioned to release the striker;

a pawl moveable within said housing between a ratchet hold position wherein said pawl is positioned to hold said ratchet in its striker capture position and a ratchet release position wherein said pawl permits movement of said ratchet out of its striker capture position;

a pawl lever coupled for movement with said pawl; and a locking mechanism including an inside release lever pivotally mounted to said housing and a release link, said inside release lever operatively connected to an inside door handle and moveable between a Rest position and a Released position in response to movement of the inside door handle, said release link coupled to said inside release lever and moveable relative to said inside release lever between an Unlock position and a Lock position in response to actuation of an operating mechanism, wherein movement of said inside release lever between its Rest position and its Released position causes movement of said release link between a Retracted position and an Extended position relative to said pawl lever, and wherein said release link is operable to selectively engage said pawl lever and move said pawl from its ratchet hold position toward its ratchet release position when said release link is positioned in its Unlock position and movement of said inside release lever from its Rest position into its Released position causes said release link to move from its Retracted position into its Extended position.

2. A vehicle door latch assembly as in claim 1, wherein said release link is pivotably coupled to said inside release lever in generally parallel relation therewith for movement between its Unlock and Lock positions.

3. A vehicle door latch assembly as in claim 1, wherein said release link includes a first end segment, a second end segment, and an elongated intermediate segment therebetween, wherein said second end segment includes an engagement face surface extending a first length, and wherein said intermediate segment includes an external cam surface and a recessed guide slot having a stop shoulder.

4. A vehicle door latch assembly as in claim 3, wherein said pawl lever includes an engagement face surface extending a second length being greater than the first length of said engagement face surface of said release link for allowing said release link to engage and move said pawl lever when said release link is moved to its Extended position in response to movement of said inside release lever to its Released position.

5. A vehicle door latch assembly as in claim 3, wherein said pawl lever includes an engagement edge surface extending a third length being less than the first length of said engagement surface of said release link for allowing said release link to engage and move said pawl lever when said release link is in its Unlock position and for causing said engagement surface of said release link to be out of alignment with said engagement edge surface of said pawl lever when said release link is in its Lock position.

6. A vehicle door latch assembly as in claim 3, wherein said locking mechanism further includes an outside release lever pivotally moveable between a Rest position and a Released position, said outside release lever having a drive flange engaging said stop shoulder of said release link when said release link is in its Unlock position and disengaging said stop shoulder of said release link when said release link is in its Lock position.

7. A vehicle door latch assembly as in claim 6 further including an outside release mechanism interconnecting an outside door handle to said outside release lever, wherein said outside release mechanism includes a pushrod coupled to said outside release lever for moving said outside release lever from its Rest position to its Released position in response to actuation of the outside door handle.

8. A vehicle door latch assembly as in claim 3 further including an inside release mechanism interconnecting the inside door handle to said inside release lever, wherein said inside release mechanism includes a release cable assembly having a cable guide member and a release cable engaging said inside release lever for moving said inside release lever between its Rest position and its Released position in response to actuation of the inside door handle.

9. A vehicle door latch assembly as in claim 3, wherein said locking mechanism further includes a lock gear pivotally moveable between a Non-Actuated position and an Actuated position by said operating mechanism, said lock gear having a cam projection for causing said release link to pivot from its Unlock position to its Lock position when said cam projection engages said external cam surface on said release link.

10. A vehicle door latch assembly as in claim 9, wherein said operating mechanism includes a power-operated actuator unit and a worm gearset, said worm gearset including a worm driving a worm gear, said power-operated actuator unit including an electric motor having a rotary output driving said worm, and wherein said worm gear is fixed to said lock gear for moving said lock gear between its Non-Actuated position and its Actuated position.

11. A vehicle door latch assembly as in claim 9 further including a lock status switch, wherein said lock gear further includes a switch tab projection for selectively activating said lock status switch when said switch tab projection engages said lock status switch to provide a signal to a centralized door lock control system indicative of the rotated position of said lock gear.

12. A vehicle door latch assembly as in claim 9 further including a key-less lock mechanism having a key lock knob, a spring-biased key-less lock lever assembly, and an elongated key lock link, wherein said elongated key lock link is coupled with said lock gear and with said key lock knob, and said spring-biased key-less lock lever assembly includes a lock lever pivotally mounted to said outside release lever for securing said lock gear.

13. A vehicle door latch assembly as in claim 1 further including a release link biasing member for biasing said release link toward its Unlock position.

14. A vehicle door latch assembly, comprising:

a ratchet moveable between a striker capture position wherein said ratchet is positioned to retain a striker and a striker release position wherein said ratchet is positioned to release the striker;

a pawl moveable between a ratchet hold position wherein said pawl is positioned to hold said ratchet in its striker capture position and a ratchet release position wherein said pawl permits movement of said ratchet out of its striker capture position;

a pawl lever coupled for movement with said pawl; and a locking mechanism including an inside release lever, an outside release lever and a release link, said inside release lever is operatively connected to an inside door handle and is moveable between a Rest position and a Released position in response to movement of the inside door handle, said outside release lever is operatively connected to an outside door handle and is moveable between a Rest position and a Released position in response to movement of the outside door handle, said release link is coupled to said inside release lever and is moveable between an Unlock position and a Lock position in response to actuation of an operating mechanism, wherein movement of said inside release lever between its Rest position and its Released position causes movement of said release link between a Retracted position and an Extended position relative to said pawl lever, wherein said release link is operable to selectively engage said pawl lever and move said pawl from its ratchet hold position toward its ratchet release position when said release link is positioned in its Unlock position and movement of said inside release lever from its Rest position into its Released position causes said release link to move from its Retracted position into its Extended position, wherein said outside release lever is engaged with said release link when said release link is positioned in its Unlock position and is disengaged therefrom when said release link is positioned in its Lock position, and wherein movement of said outside release lever from its Rest position into its Released position when said release link is in its Unlock position causes said release link to move from its Retracted position into its Extended position for engaging said pawl lever and moving said pawl out of its ratchet hold position.

15. A vehicle door latch assembly as in claim 14 further including a ratchet biasing member for biasing said ratchet toward its striker release position, a pawl biasing member for biasing said pawl toward its ratchet hold position, an inside release lever biasing member for biasing said inside release lever toward its Rest position, an outside release lever biasing member for biasing said outside release lever toward its Rest position, and a release link biasing member for biasing said release link toward its Unlock position.

16. A vehicle door latch assembly as in claim 14, wherein said release link includes a first end segment, a second end segment, and an elongated intermediate segment therebetween, and wherein said second end segment includes an engagement surface extending a first length, and wherein said intermediate segment defines an external cam surface and a recessed guide slot having a stop shoulder.

17. A vehicle door latch assembly as in claim 16, wherein said outside release lever has a drive flange engaging said stop shoulder of said release link to pivot said pawl lever when said release link is in its Unlock position and disengaging said stop shoulder of said release link when said release link is in its Lock position.

18. A vehicle door latch assembly as in claim 16, wherein said pawl lever includes an engagement face surface extending a second length that is greater than the first length of said engagement surface of said release link for allowing said release link to engage and move said pawl lever when said release link is in its Lock position and when said release link is in its Unlock position.

19. A vehicle door latch assembly, comprising:

A ratchet moveable between a striker capture position wherein said ratchet is positioned to retain a striker and a striker release position wherein said ratchet is positioned to release the striker;

a ratchet biasing member for biasing said ratchet toward the striker release position;

a pawl moveable between a ratchet hold position wherein said pawl is positioned to hold said ratchet in the striker capture position and a ratchet release position wherein said pawl permits movement of said ratchet out of the striker capture position, said pawl having a pawl lever;

a pawl biasing member for biasing the pawl to the ratchet holding position;

an inside release lever operatively connected to an inside door handle and moveable between a Rest position and a Released position in response to movement of the inside door handle;

an outside release lever operatively connected to an outside door handle and moveable between a Rest position and a Released position in response to movement of the outside door handle;

a release link pivotably connected to said inside release lever for movement between an Unlock position and a Lock position; and a lock gear rotatable between a Non-Actuated position and an Actuated position, said lock gear having a cam segment engageable with said release link for positioning said release link in its Unlock position when said lock gear is in its Non-Actuated position and for positioning said release link in its Lock position when said lock gear is in its Actuated position;

wherein movement of said inside release lever between its Rest and Released positions causes movement of said release link between a Retracted position and an Extended position relative to said pawl lever, and wherein said release link is operable to engage said pawl lever and move said pawl out of its ratchet hold position when said release link is located in its Unlock position and said inside release lever causes said release link to move from its Retracted position to its Extended position.

20. A vehicle door latch assembly as in claim 19, wherein said release link includes a first end segment, a second end segment, and an elongated intermediate segment therebetween, wherein said second end segment includes an engagement surface, and wherein said intermediate segment defines a recessed guide slot having a stop shoulder.

21. A vehicle door latch assembly as in claim 20, wherein said outside release lever has a drive flange engaging said stop shoulder of said release link to engage said pawl lever and move said pawl out of its ratchet hold position when said release link is in its Unlock position and said outside release lever is moved to its Released position.

* * * * *